US007990086B2

(12) United States Patent
Figueras Mitjans

(10) Patent No.: US 7,990,086 B2
(45) Date of Patent: Aug. 2, 2011

(54) SEAT-ASSEMBLY MOVEMENT SYSTEM

(75) Inventor: Jose Figueras Mitjans, Llica D'Amunt (ES)

(73) Assignee: Figueras International Seating, S.A., Barcelona (ES)

( * ) Notice: Subject to any disclaimer, the term of this patent is extended or adjusted under 35 U.S.C. 154(b) by 530 days.

(21) Appl. No.: 12/160,136

(22) PCT Filed: Apr. 26, 2007

(86) PCT No.: PCT/ES2007/000250
§ 371 (c)(1),
(2), (4) Date: Jul. 7, 2008

(87) PCT Pub. No.: WO2007/128852
PCT Pub. Date: Nov. 15, 2007

(65) Prior Publication Data

US 2009/0019785 A1 Jan. 22, 2009

(30) Foreign Application Priority Data

May 3, 2006 (ES) ..... 200601110

(51) Int. Cl.
*H02P 7/00* (2006.01)

(52) U.S. Cl. ..... 318/265; 318/266; 318/286; 318/466

(58) Field of Classification Search ..... 318/265, 318/266, 286, 466, 468; 297/232, 234, 235, 297/310, 330, 331, 344.22, 344.23; 52/8, 52/10, 111, 116, 117
See application file for complete search history.

(56) References Cited

U.S. PATENT DOCUMENTS

| | | | | |
|---|---|---|---|---|
| 3,881,140 | A * | 4/1975 | Hartman | 318/85 |
| 5,374,878 | A * | 12/1994 | Becher et al. | 318/49 |
| 5,517,789 | A * | 5/1996 | Sugiyama | 52/10 |
| 5,529,378 | A * | 6/1996 | Chaban et al. | 297/331 |
| 6,199,325 | B1 * | 3/2001 | Winship | 52/10 |
| 7,172,245 | B2 * | 2/2007 | Bouchard et al. | 297/217.7 |

FOREIGN PATENT DOCUMENTS

| | | |
|---|---|---|
| DE | 4233823 A | 4/1994 |
| ES | 2016896 | 12/1990 |
| ES | 1039056 | 10/1998 |
| FR | 2634438 | 1/1990 |
| WO | 2006097554 | 9/2006 |

* cited by examiner

*Primary Examiner* — Bentsu Ro
*Assistant Examiner* — Thai Dinh
(74) *Attorney, Agent, or Firm* — Lucas & Mercanti, LLP

(57) ABSTRACT

Seat-assembly movement system, for collecting up and deploying rows of seats (1) at the installation site, by means of sliding on guides (2) arranged in the floor, the movement of the rows of seats (1) being managed by means of a control system comprising a master PLC or a computer unit, for governing the installation, in combination with respective slave PLCs arranged on the carriages (3) carrying the rows of seats and in connection with devices for controlling the position of said carriages (3) on the mounting guides (2).

4 Claims, 26 Drawing Sheets

SEAT-ASSEMBLY MOVEMENT SYSTEM

FIELD OF THE ART

The present invention relates to the adaptation of halls or enclosures for their use in activities requiring free space and activities requiring an arrangement of seats to be occupied by the participating people, proposing a movement system applicable to seat assemblies, particularly for groups of seats arranged in rows, determining a motor-driven movement capacity of said rows of seats, for their deployment or removal in relation to the surface of the application enclosure.

STATE OF THE ART

There are premises intended to be occasionally used in different activities, in which in some cases the surface of the enclosure is required to be free from obstacles, for sports for example, whereas in other cases an arrangement of seats is required to be occupied by the attendees, for example for conferences and similar meetings.

The conventional transformation of the premises in such sense is based on the use of generally foldable chairs which are placed and removed depending on their requirement in the premises, this being a very laborious task due to the work required by the placement and removal of the chairs and their storage, in addition to the fact that the chairs suitable for this purpose are generally not very comfortable.

Solutions for installing seats in a mobile assembly have been developed, such that they can be moved by means of sliding on guides between a collected and stored position, freeing up the surface of the application premises, and a deployed position for the use, distributed on the mentioned surface of the premises.

The existing solutions in this sense are complicated and expensive, involving problems that are not satisfactorily solved, such as the automation of the movement of the rows of seats and of the covering of the guides, in practical assembly and operational conditions.

OBJECT OF THE INVENTION

According to the invention, a movement system for the rows of seats is proposed, whereby the aforementioned aspects are advantageously solved as a result of the functional arrangement features determining very effective operational conditions, with a simple assembly.

The application installation of the proposed system consists of guides formed by grooved profiles which are inserted in the floor, on which guides the bases for supporting the seats forming each row are incorporated in a rolling assembly by means of corresponding carriages.

The movement system according to the invention is applied along the guides of the assembly, including through said guides the means for actuating the movement, as well as the data supply and electric transmission means for actuating and controlling the movement.

The control of the movement is managed from a master PLC governing the entire installation, in connection with respective slave PLCs arranged on the roller carriages supporting the rows of seats on the movement guides and in combination with devices for controlling the position (such as encoders, teeth counters etc.) also arranged on the carriages on which the rows of seats are supported, which rows are preferably provided in an assembly on two parallel guides by means of respective roller carriages, without this being limiting.

A system is thus obtained in which everything related to the movement of the rows of seats is individually controlled in the roller carriages by means of the slave PLC arranged therein, such that the slave PLC of each carriage receives the signals of the devices for controlling the position of the corresponding carriage and sets up a transmission-reception communication with the master PLC of the installation which, depending on the signals it receives from the slave PLC and according to the pre-established programming, sends other signals of commands to be executed, depending on which the slave PLC makes the operative means of the movement of the respective carriage act.

The transmission of the movement can be individual or collective, in connection with the rows of seats, the individual transmission being carried out by means of motors incorporated in the actual carriages for supporting the rows of seats, either by a gear play between a pinion associated to the corresponding motor and a rack incorporated along the movement guide, or by a drive transmission from the respective motor to the support wheels of the carriage on the guide; whereas the collective transmission is carried out by driving by means of a chain or a cable running along the guide and actuated by means of one or two motors from the ends.

Said transmission of the movement is established by each of the movement guides of the rows of seats, an independent motorization being able to be applied in connection with each of the guides, with a synchronization control by the master PLC of the system between the motorizations corresponding to the transmissions by the different movement guides of the rows of seats; but the drive is also provided by means of a single motorization, in connection with the transmission by a guide and mechanical synchronization, by means of one or more transverse shafts, with the transmission by the other movement guide of the rows of seats.

The transmission of the movement by means of driving by means of chains or cables can be combined with individual anchors for locking the carriages supporting the rows of seats, on the corresponding movement guide, which allows carrying out an independent movement, allowing to place the desired seats in the distribution for use, whereas the rest are collected and stored.

The power supply conduction to the mechanisms incorporated in the carriages supporting the rows of seats, as well as the data transmission between the master PLC of the installation and the slave PLCs of the carriages, is established through busbars which are incorporated along the actual movement guides, for which the guides determine longitudinal housings in which said busbars are fitted in a position in which the support of contact rollers incorporated by the carriages is established thereon, such that the data transmission and electrical connection is maintained constant and permanent during the movement of the rows of seats along the mounting guides.

An alternative solution is provided for communicating the data transmission to the carriages of the rows of seats from a control computer by means of a wireless transmission plate, whereby the physical elements in the transmission are eliminated, with improvements in the cost, further allowing other functionalities such as the automatic sending of errors in the movement means and failure diagnosis and the contribution of solutions by means of Internet connection.

Between the rows of seats, the guides are covered with plates by way of lids determining the surface continuity of the floor in which the installation of the rows of mobile seats is to be implemented, which plates for covering the guides can be manually incorporated and removed, but an automatic solution is also provided for pivoting said plates between a lowered position on the guides when the rows of seats are deployed and a raised position when the rows of seats are collected and stored.

To that end, the plates for covering the guides between consecutive rows of seats are articulated with the carriages for supporting the rows of seats, said plates being able to be pivoted by means incorporated in the corresponding carriages, such as an electromagnet for example.

However, a preferred solution is provided for said automatic pivoting of the plates for covering the guides, based on a ramp arranged on the respective guide in the area of entrance to the collection storage of the rows of seats, and a sliding or roller stop arranged in each pivoting plate. A solution is particularly provided with two support stops in different phases of the pivoting of the plates and a ramp with two different sections for the support of said stops, whereby achieving a uniform and non-abrupt pivoting of the plates.

The assembly of the installation can be established for collecting up the rows of seats in any type of housings annexed to the application enclosure, the floor of the enclosure being able to have mobile parts between a horizontal position and an inclined position in order to arrange rows of seats in the use for watching a stage for example, and/or with the possibility of allowing the movement of the rows of seats for their housing and extraction in relation to storage sites located at a lower level.

In the same way, certain parts of the floor and/or the stage of the premises is capable of vertical movement between different height positions in order to lower and raise the rows of sets between the floor level of the premises and a storage located under the stage or under the floor, a solution being provided in this case for actuating the movement in height of said mobile parts by means of a system of four spindles driven through corresponding transmissions by a single motor. This solution of spindles is not limiting because other actuation solutions, such as for example by means of hydraulic cylinders, pinions and racks, etc., can be applied with the same effect for the operation of the system.

The floor can also be provided with rotating areas provided with guide sections for the movement of the rows of seats, such that by means of said areas the orientation of the movement of the rows of seats, in relation to perpendicular directions for example, can be changed by extending the possibilities of distributing the rows of seats for the use and/or collection storage thereof in different sites.

The system of the invention thus has certainly advantageous features, acquiring its own identity and a preferred character for the function of the movement of the rows of seats in the mentioned application of fitting out enclosures, with or without seats, depending on the activities to be carried out.

DETAILED DESCRIPTION OF THE INVENTION

Figure 1:
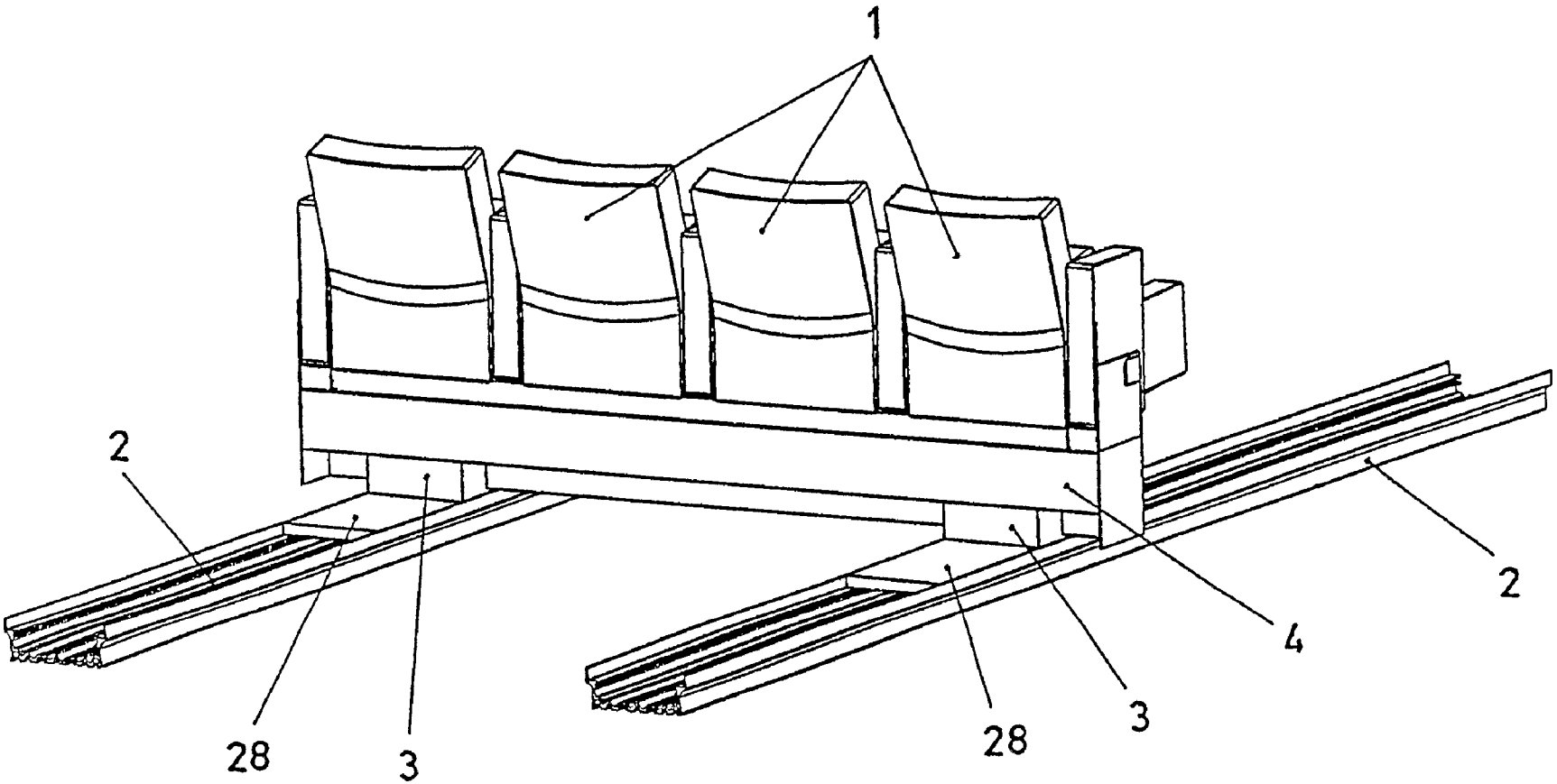
FIG. 1 shows a perspective view of a seat assembly assembled on movement guides according to the invention.
Figure 2:
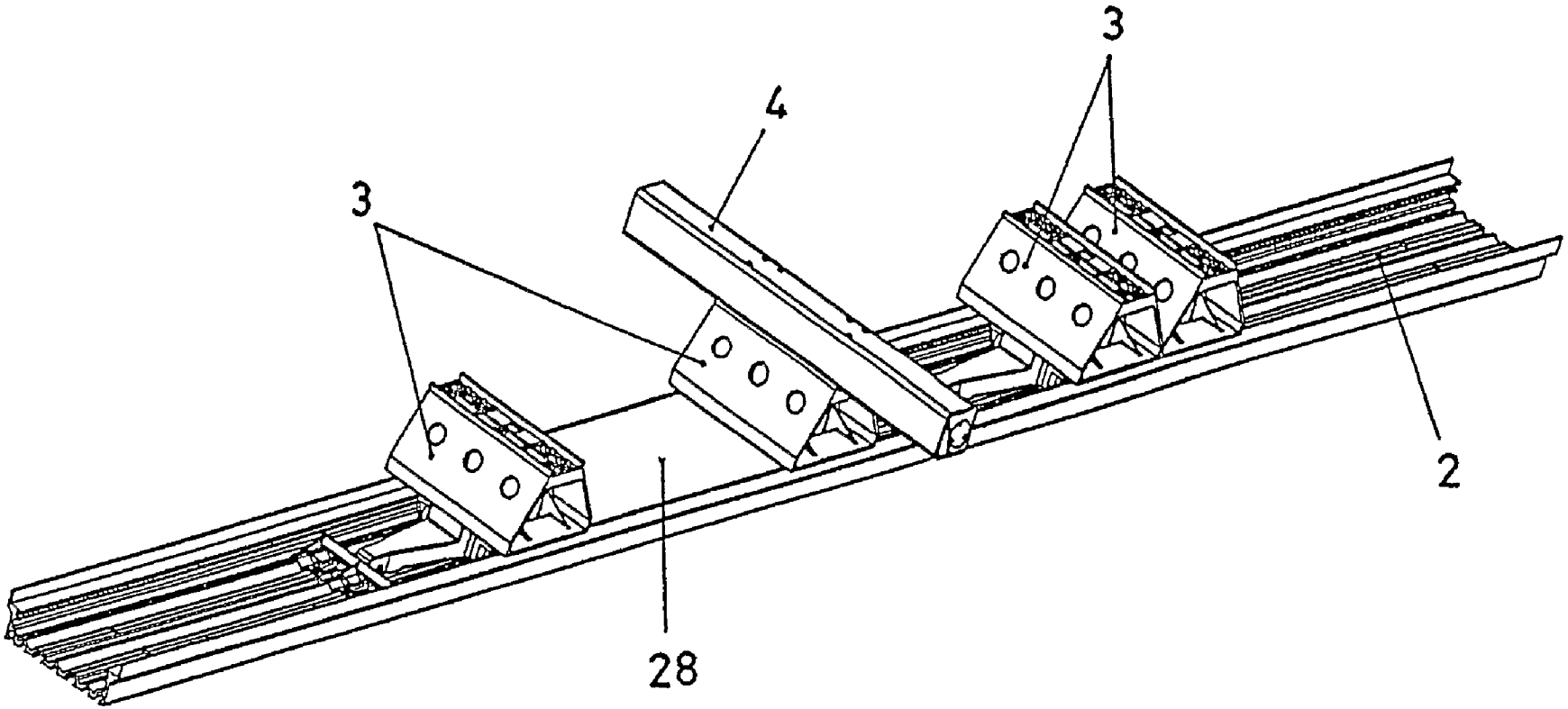
FIG. 2 shows a perspective view of an arrangement of a series of carriages for supporting different rows of seats, on a movement guide.
Figure 3:
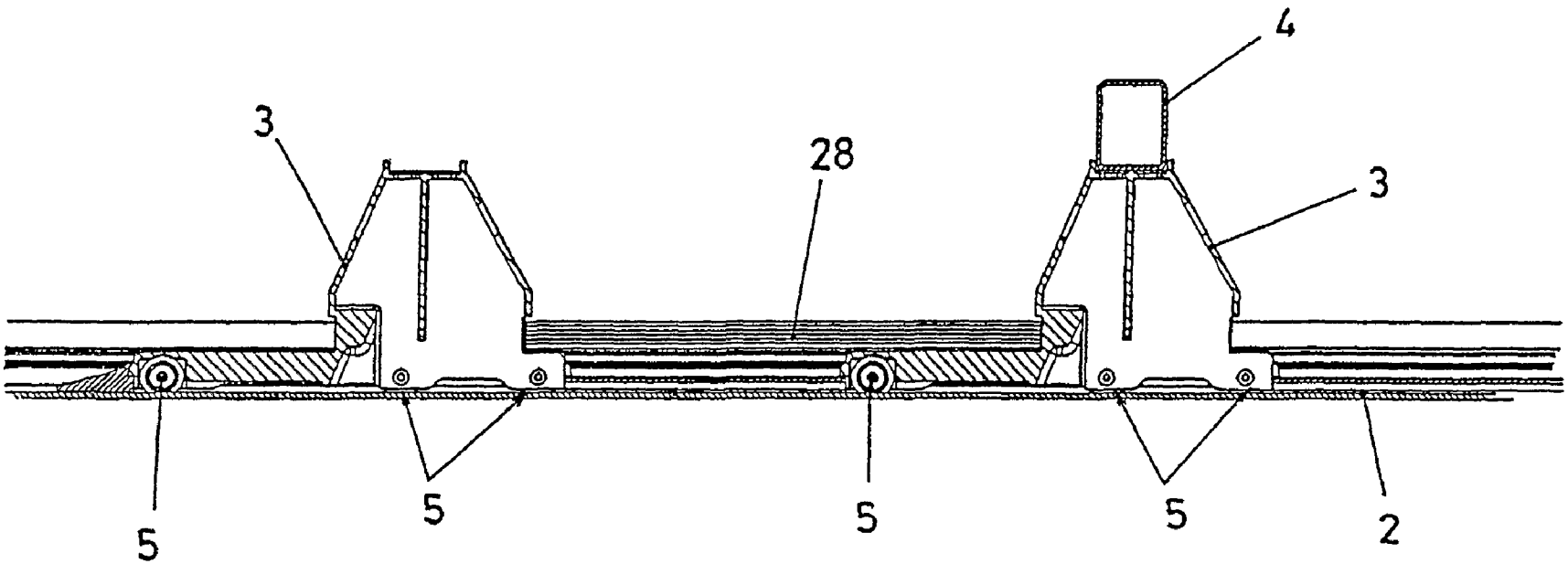
FIG. 3 is an enlarged side view of a part of the assembly of the previous figure.

The object of the invention relates to a movement system for rows of seats of the type arranged in some premises with the possibility of deployment or collection in order to adapt the premises to the use conditions with or without the seats.

The rows of seats (1) are assembled for this purpose on parallel guides (2), in relation to which the rows of seats (1) can be moved between a use position in the premises and a collected position in storage sites provided for that purpose.

The assembly of the rows of seats (1) on the corresponding guides (2) is established by means of supporting carriages (3), on which there is incorporated in each case a base (4) on which the seats (1) of the row are arranged.

The carriages (3) are supported on the guides (2) in a rolling arrangement by means of wheels (5), for which the guides (2) determine longitudinal conformations (6) by way of rails, the wheels (5) determining a contour shape in combination with the mentioned conformations (6) by way of rails, therefore the rolling assembly establishes a fitting preventing inter-rotations and derailments.

Figure 4:
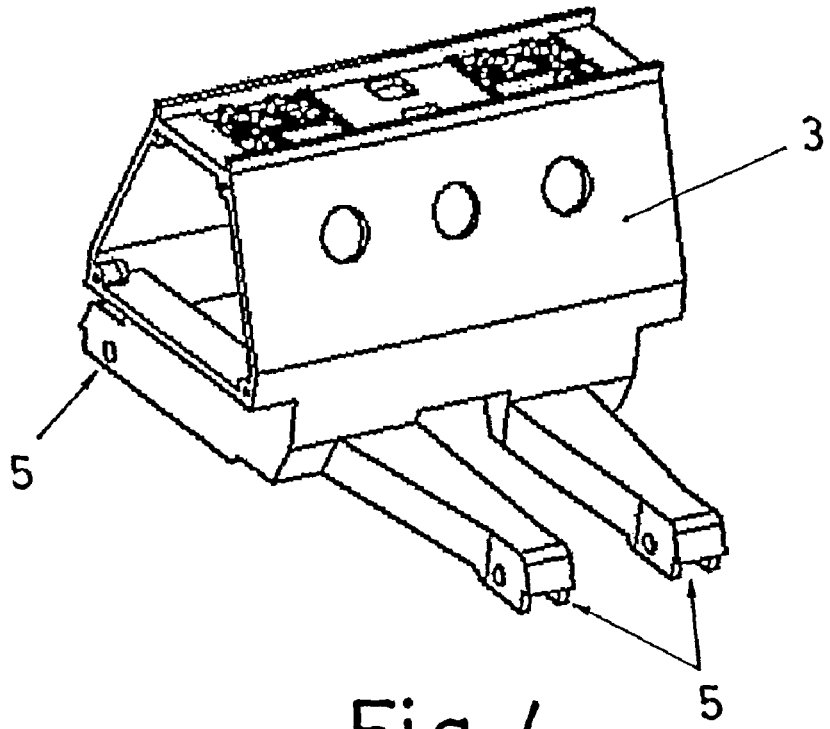
FIGS. 4 and 5 are respective embodiments of the carriages for supporting the rows of mobile seats.
Figure 5:
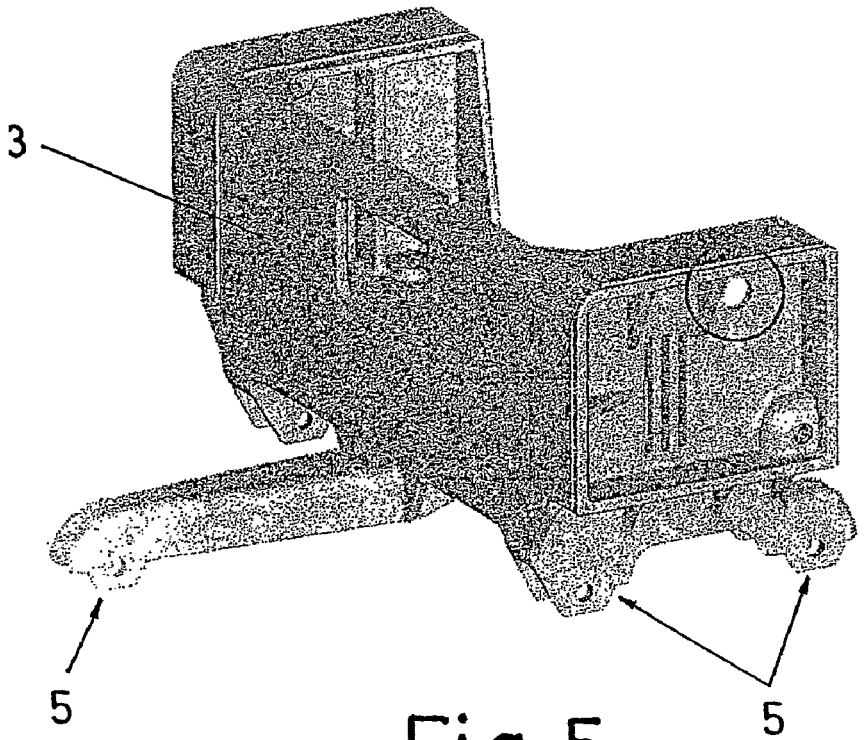

The guides (2) consist of profiles with a grooved shape, being able to take on different configurations depending on the assembly to be established thereon, since the carriages (3) may also have different embodiments depending on the supporting strength required, being able to have four or five wheels (5) for example, like the embodiments of FIGS. 4 and 5 which are, however, non-limiting examples.

Figure 6:
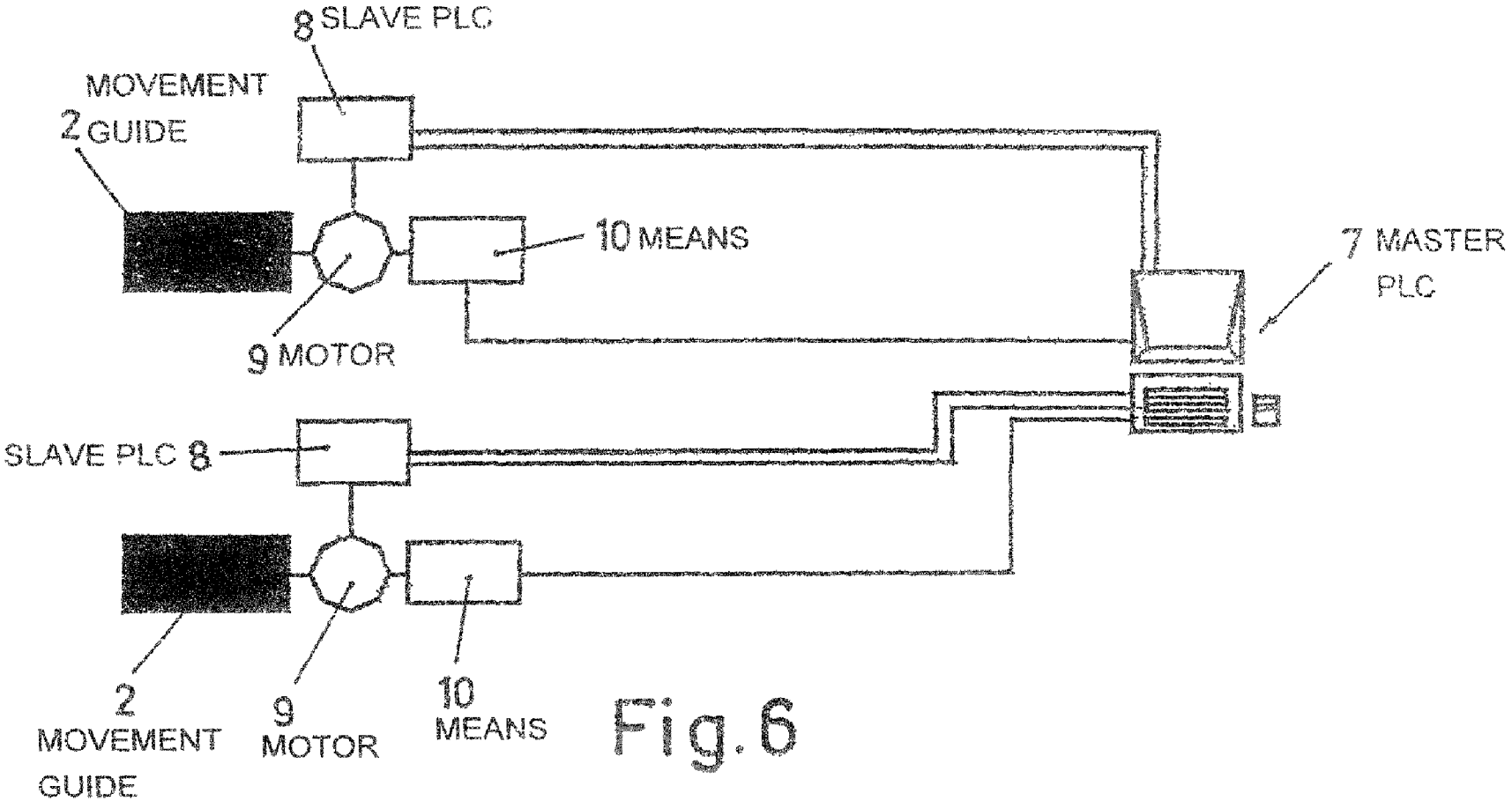
FIG. 6 is a diagram of the system for controlling the movement of the rows of seats of an installation according to the invention.

The movement of the rows of seats (1) is determined by means of a motorization, which can be incorporated in the actual carriages (3) or act under a mobile drive transmission along the guides (2), the process of the movements being controlled by means of a system (FIG. 6) comprising a master PLC (7) and respective slave PLCs (8) arranged in the different carriages (3) on which the rows of seats (1) are supported, such that by means of the slave PLCs (8) of the carriages the activity of the operation of the corresponding drive motor (9) for the movement and for the means (10) for locking and releasing the movement is determined.

To that end, devices for controlling the position which are arranged in each carriage (3) emit signals depending on the position of the corresponding carriage (3) in relation to the movement guide (2), said signals being collected by the slave PLC (8) of the carriage, which transmits the signals to the master PLC (7) and the latter, depending on said signals and on an established programming, processes governing signals that it sends in turn to the slave PLC (8) of the carriage, such that the latter, depending on said signals, commands the actuation of the motor (9) and of the means (10), determining the process of the movements and stops of the respective carriage (3) and with it, the movements of the rows of seats (1) by means of the movements of the carriages (3) supporting them.

Figure 7:
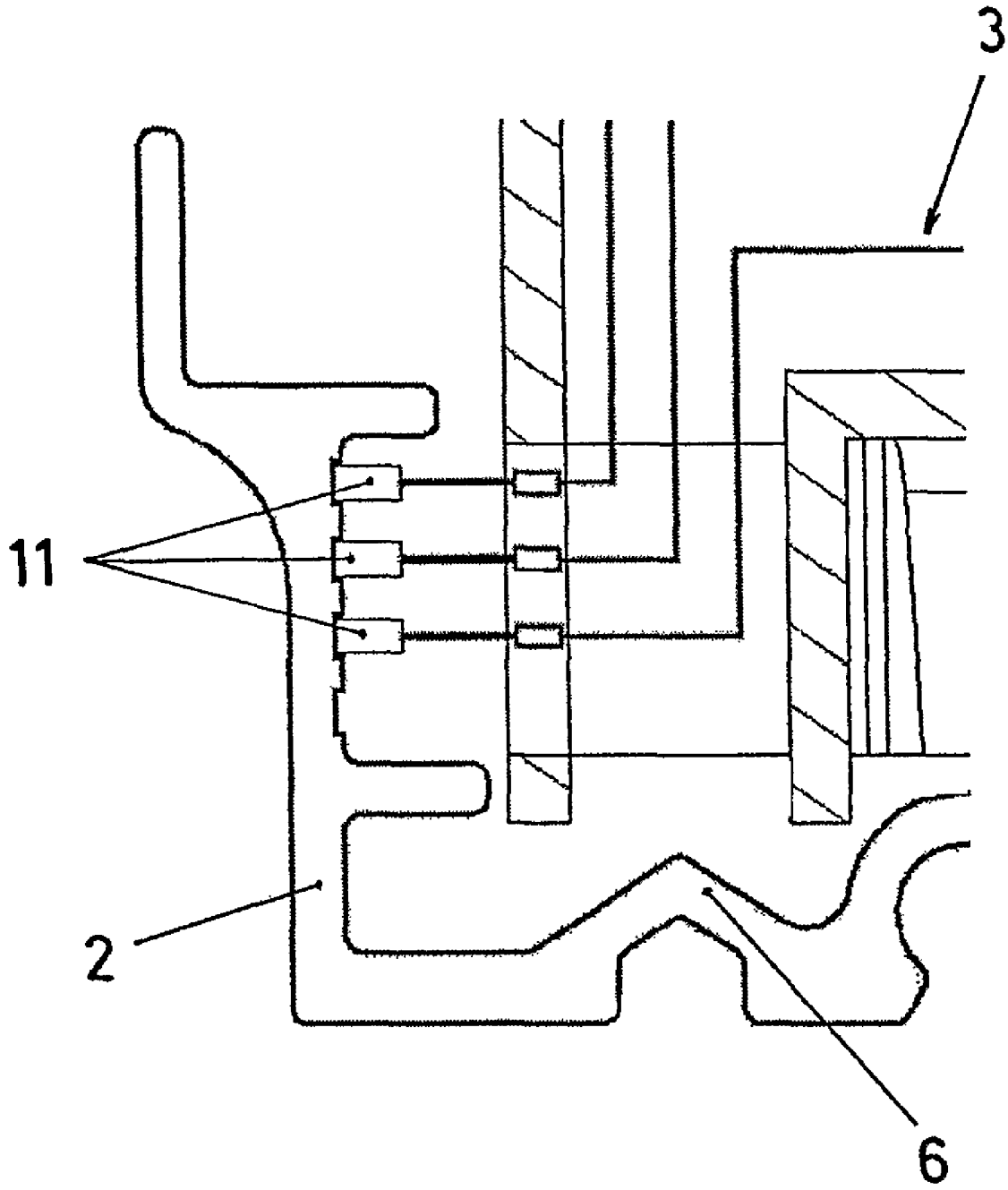
FIG. 7 is detail of a partial view of a guide of the mobile assembly of the rows of seats, the data and electric transmission being observed along the guide to a carriage carrying the rows of mobile seats.

The electrical connection to the operative elements which are incorporated in the carriages (3), as well as the communication of data signals between the master PLC (7) of the installation and the slave PLCs (8) of the carriages (3), is established through busbars (11) incorporated along guides (2), on which the installation of the carriages (3) establishes a sliding contact by means of rollers acting as brushes, as shown in FIG. 7, such that the connection is continuous during the movement of the movements.

In these conditions, the signals transmitted by the master PLC (7) of the installation are received by all the slave PLCs (8) of the carriages (3), such slave PLCs discriminating whether the signals correspond to their carriage (3), such that when this is so, they apply them while governing the means of their carriage (3), as appropriate, and ignore them when they are signals intended for other carriages (3).

Figure 8:
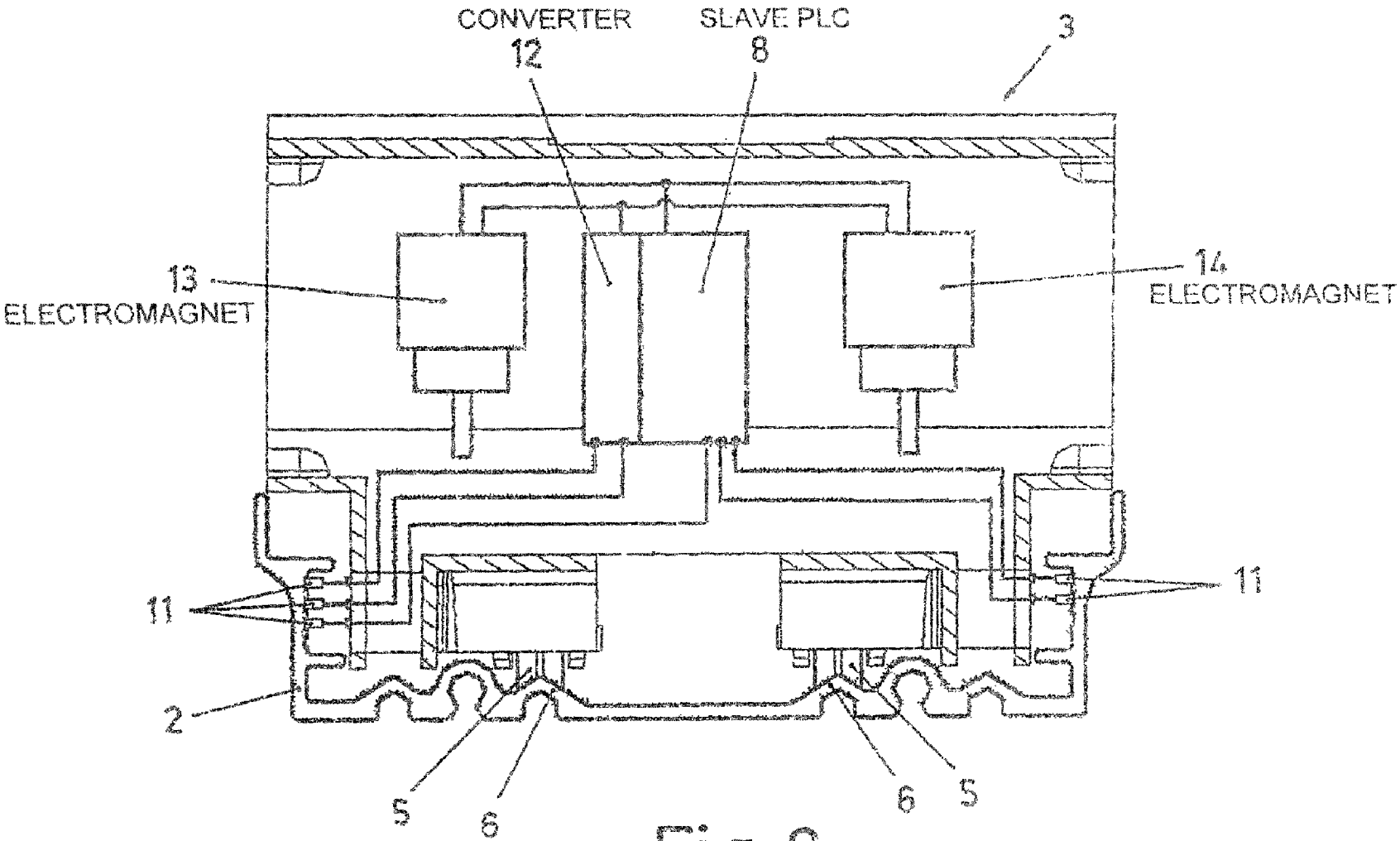
FIG. 8 schematically shows the arrangement of a carriage carrying the rows of mobile seats for the mode of driving by a chain or cable.
Figure 9:
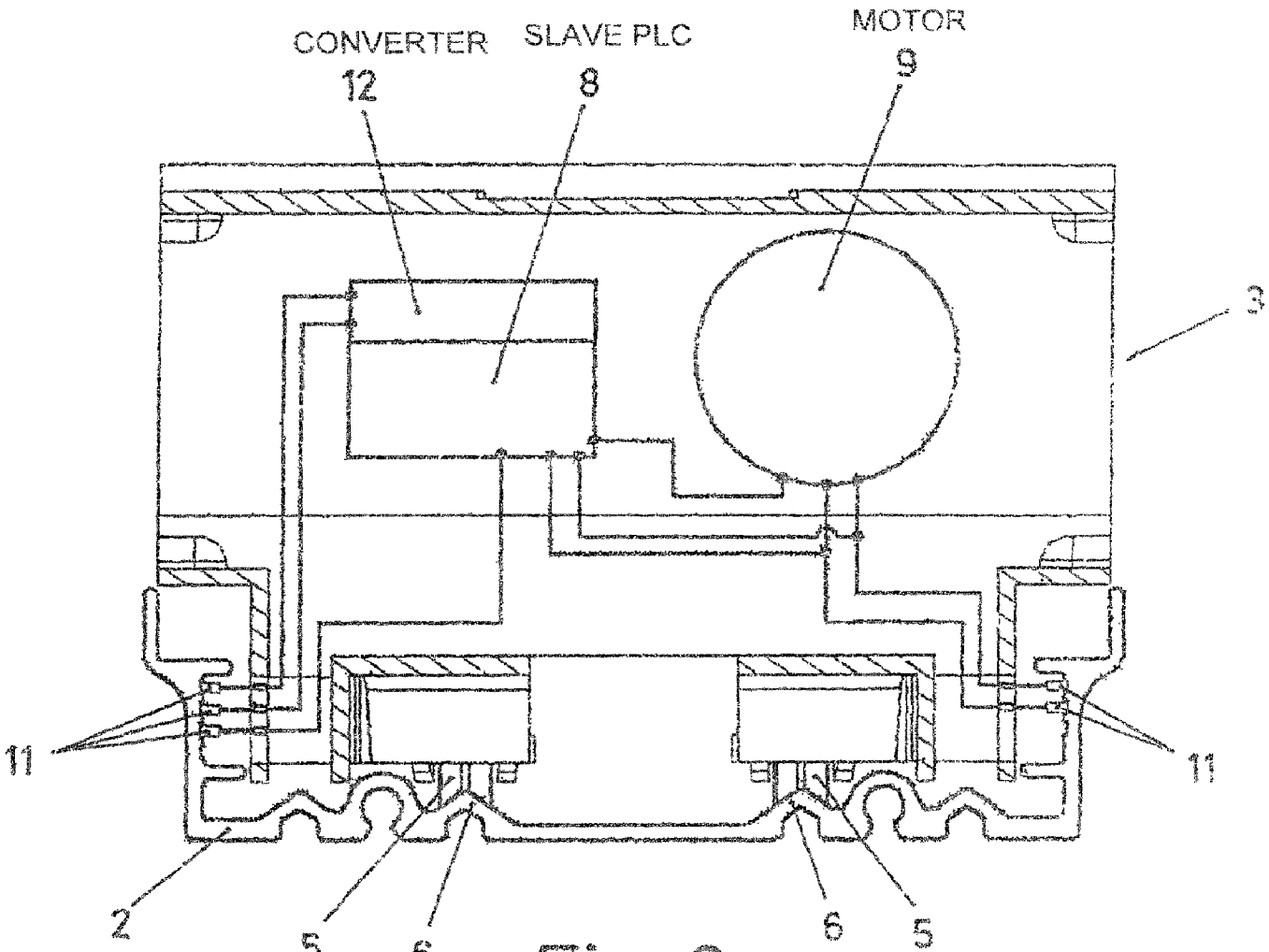
FIG. 9 schematically shows the arrangement of a carriage carrying the rows of mobile seats for the mode of movement with motorization in the actual carriage.

The arrangement of the movement transmission for the movement of the rows of seats (1) can be by means of a joint action drive of the rows of seats (1) by means of chains or cables extending and moving along the guides (2), each carriage (3) being equipped in this case, as shown in FIG. 8, with the corresponding slave PLC (8), with a signal converter (12) and two electromagnets (13 and 14), in addition to at least one position detector (not shown).

The movement transmission can also be of the individual movement of the rows of seats (1), each carriage (3) being equipped in this case, as shown in FIG. 8, with the corresponding slave PLC (8), with a signal converter (12) and with a movement motor (9), in addition to at least one position detector (not shown).

In any of the cases, the control of the movement of the carriages (3) is carried out by the slave PLCs (8) which are incorporated in the carriages (3), depending on the commands that they receive from the master PLC (7) of the installation, the communication of the master PLC (7) to the slave PLCs (8) being encoded from RS232 to RS485, such that said signals are received by the converters (12) of the carriages (3), which converters decode them, discriminating whether or not they correspond to their carriage (3), in order to pass them to the slave PLC (8) of said carriage (3) or ignore them.

In the case of movement by the joint drive of the rows of seats (1), the slave PLCs of the carriages (3) activate/deactivate the electromagnets (13 and 14) such that when a signal occurs that a row of seats (1) must be moved, in the carriages (3) therefore the first electromagnet (13) is activated, positioning its rod such that it can be engaged by the drive means (cable or chain), whereby the respective carriages (3) are driven, the movement of the row of seats (1) occurring.

Upon reaching the row seats (1) at the end of the movement that it must carry out, the second electromagnet (14) of the carriages (3) is activated, whereby a locking of the row of seats (1) in both directions is established, in relation to the drive means which remains stopped. When the row of seats (1) must be moved in the opposite direction, the first electromagnet (13) of the carriages (3) is deactivated and drive means then act in relation to the second electromagnet (14), causing the drive in the opposite direction, in the same way as in the previous movement.

The drive means (cable or chain) are actuated in this case by means of one or more motors (9) located in the end sites of the movements, the control of said motors (9) being established directly from the master PLC (7) of the installation through encoders and frequency variators which, applied on the motors (9) manage the operation thereof for the movements.

In the case of individual movement of the rows of seats (1), the movement motors (9) are incorporated in the actual carriages (3), receiving the commands of the master PLC (7) through the corresponding slave PLC (8) depending on the signals emitted by the position detectors arranged in the carriage (3) itself.

Figure 23:
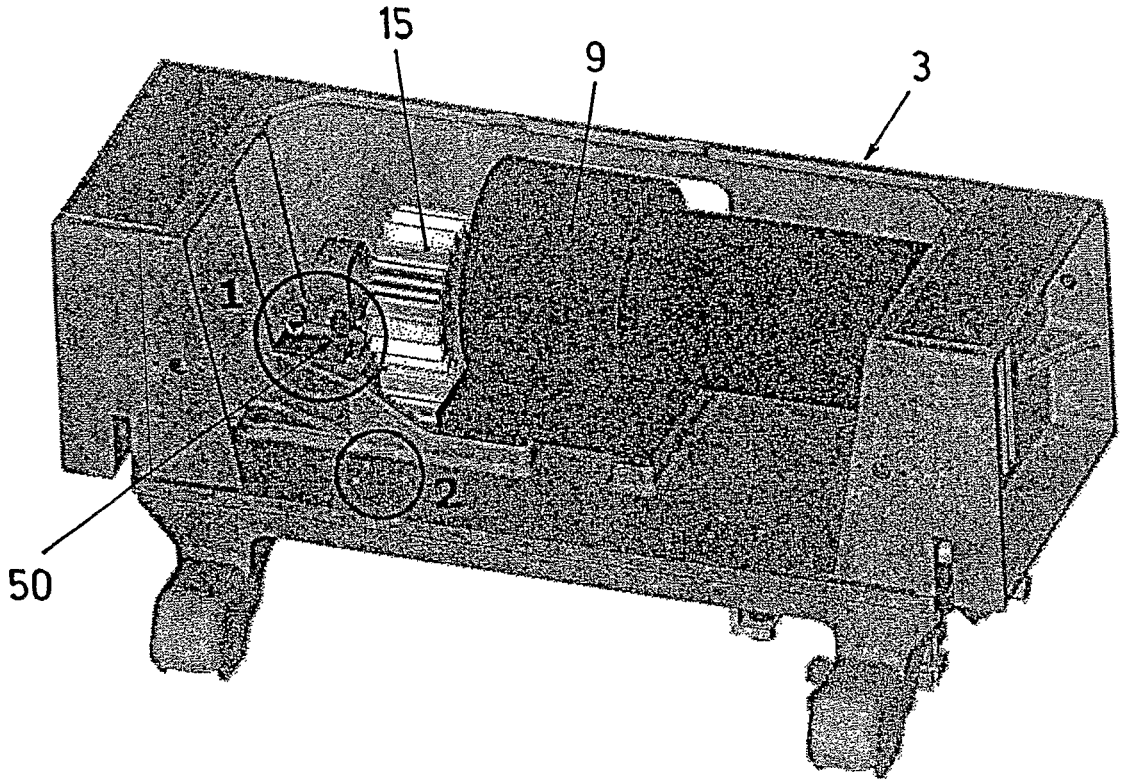
FIG. 23 is a perspective detail of the arrangement of a position detector in a carriage, in relation to the pinion actuating the movement.

The position detectors can determine the signals in relation to a toothed rack incorporated along the corresponding guide (2) or in relation to the toothing of the drive pinion (15) associated to the movement motor (9), as in the example of FIG. 23, showing a detector (50) arranged in connection with the movement drive pinion (15), whereby a perfect control accuracy is achieved.

Figure 10:
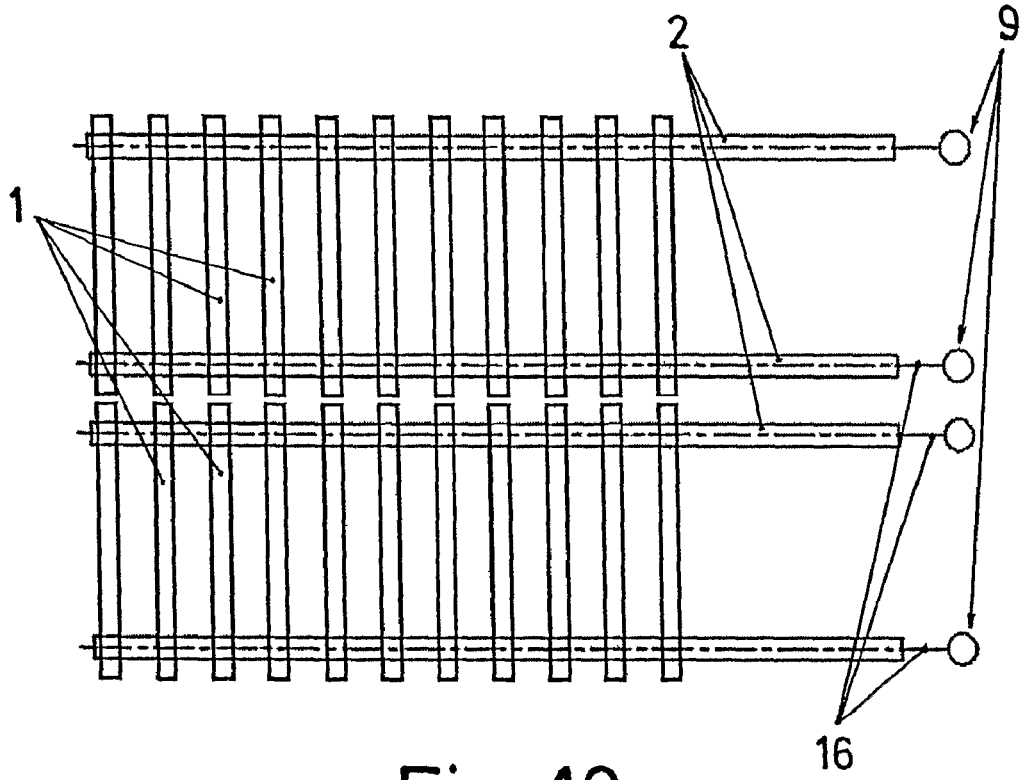
FIG. 10 is a plan diagram of the movement arrangement of the rows of seats by driving by means of a chain.

FIG. 10 shows an arrangement of the installation of the drive transmission of the rows of seats (1) by means of chains, a chain (16) being arranged passing along each of the guides (2) of the assembly of the rows of seats (1), with a respective drive motor (9) of each of said chains (16) arranged at an end of the installation.

Figure 11:
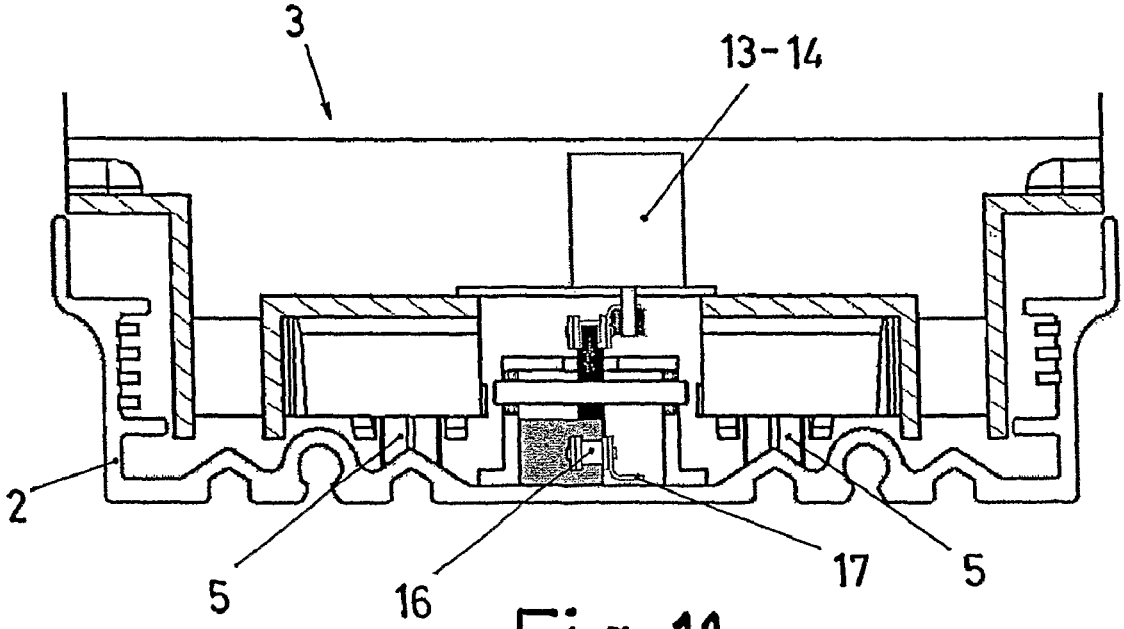
FIG. 11 schematically shows the arrangement of a carriage carrying the rows of mobile seats for said form of movement of the previous figure.

As observed in FIG. 11, the drive chains (16) are provided with bolts (17) emerging sideways from every certain section, such that said bolts (17) play in relation to the rods of the electromagnets (13 and 14) of the carriages (3) in order to determine the drive of the movement of the rows of seats (1) and the locking thereof in the stop sites, in relation to the actual chains (16).

The sequence of the movement of each row of seats (1), with this arrangement, is as follows: when the movement command is received, the motor (9) of each carriage (3) of the corresponding row of seats (1) is started, whereby the drive chains (16) start to move, the first electromagnet (13) of the carriages (3) being activated such that upon passing one of the bolts (17) of the respective chain (16), it engages on the rod of said electromagnet (13), thus causing the drive of the carriage (3) and with it, the movement of the row of seats (1).

Once the movement has started, the second electromagnet (14) of the carriages (3) is also activated, establishing in turn a respective locking of the actual bolt (17) of the chains (16) on the other side, whereby the row of seats (1) is completely locked in the chains (16), such that upon reaching the end of the run, the motors (9) are stopped and the row of seats (1) is statically locked by means of the actual chains (16).

The possibility is contemplated that the carriages (3) incorporate a third electromagnet (not shown) to establish a locking in the static positions on the floor or in relation to the mounting guide (2), whereby a better safety in the immobilization of the rows of seats (1) in the static positions is achieved and said locking in turn allows making the carriages (3) of the chains (16) independent in the static positions, some rows of seats (1) being able to be moved whereas other rows remain stopped, in order to determine different distributions of use of the assemblies of rows of mobile seats (1) in the application sites.

Figure 12:
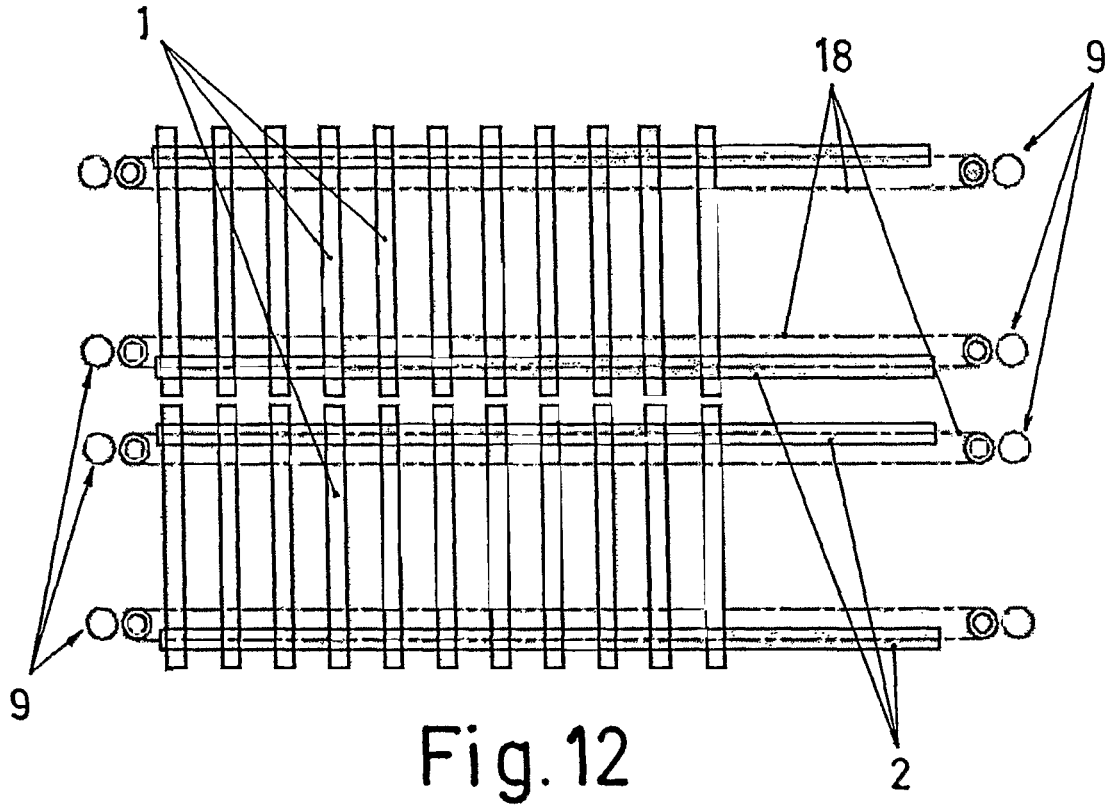
FIG. 12 is a plan diagram of the movement arrangement of the rows of seats by driving by means of a cable.

FIG. 12 shows an arrangement of the installation of the rows of seats (1) by means of cables, a respective cable (18) being arranged in this case passing along each of the mounting guides (2) of the rows of seats (1), with respective drive motors (9) in each case arranged at the ends of the installation.

Figure 13:
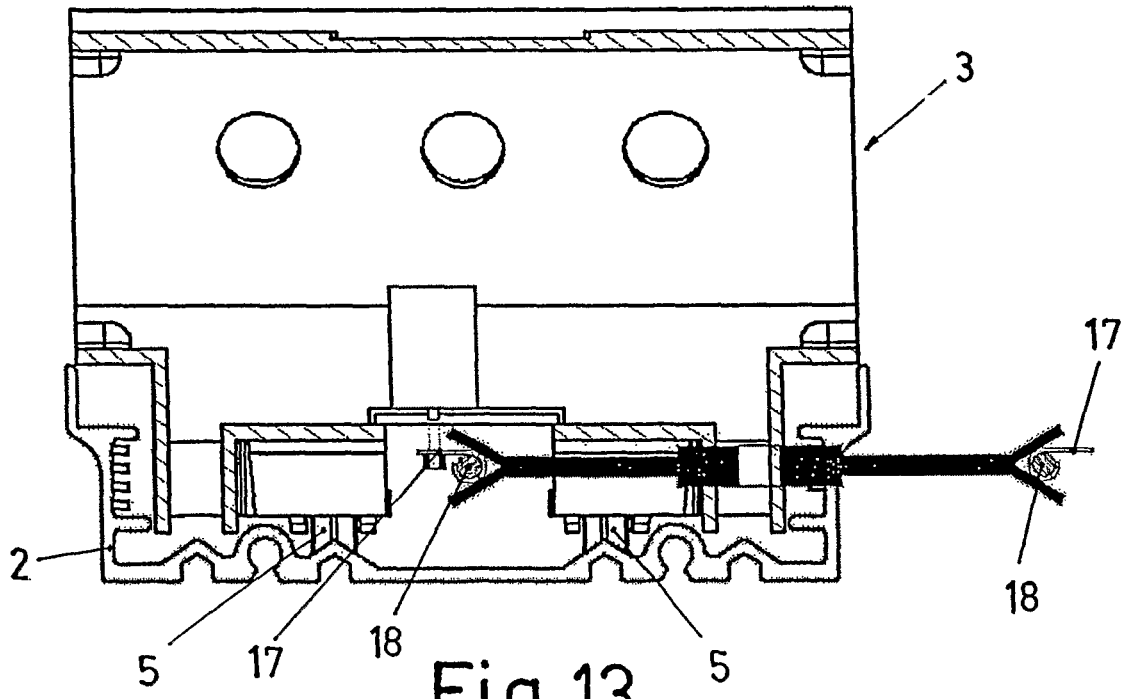
FIG. 13 shows the arrangement of a carriage carrying the rows of mobile seats for the form of movement by a cable, according to one embodiment.

In this case, the cables (18) can be provided with a distribution of bolts (17) projecting sideways, as in the case of the chains (16), as observed in FIG. 13, the operation of the movement of the rows of seats (1) being the same as with the chains (16) described above, but in this case by means of a drive actuation of the cables (18) provided from both ends of the installation by the respective motors (9).

Figure 14:
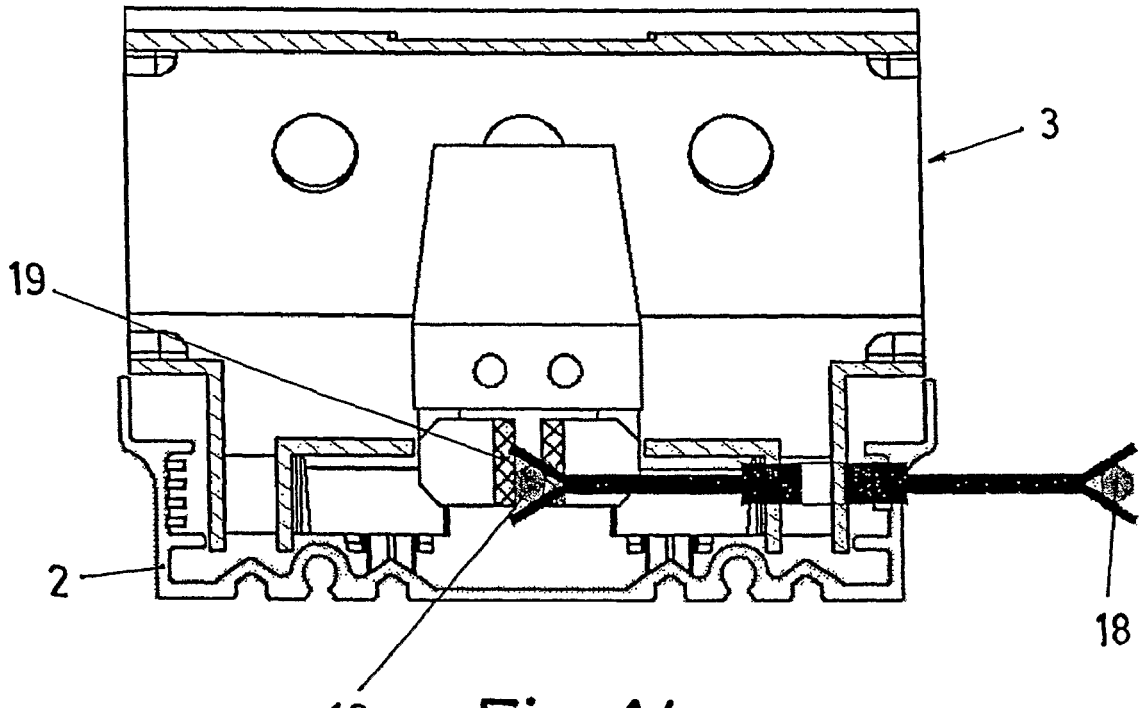
FIG. 14 shows the arrangement of a carriage carrying the rows of mobile seats for the form a of movement by a cable, according to another embodiment.

The connection to establish the drive in the movements between the carriages (3) of the rows of seats (1) and the drive cables (18) an also be carried out by means of clamps (19) incorporated in the carriages (3), as observed in FIG. 14, instead of the previously described combination of electromagnets (13 and 14) and bolts (17). The clamps (19) can in such case be of any type which allows establishing a capture and release in relation to the cables (18), for example a pneumatic, electromagnetic or any other capture and release.

Figure 15:
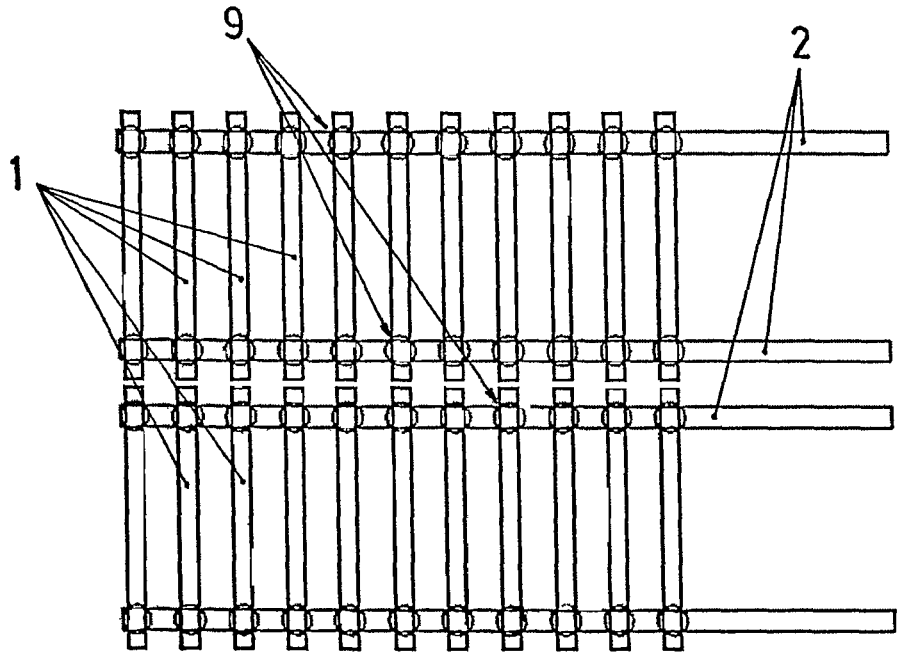
FIG. 15 is a plan diagram of the movement arrangement of the tows of seats with motorization in the actual supporting carriages.

FIG. 15 shows an arrangement of the drive transmission installation of the rows of seats (1) by means of motorization incorporated in the actual carriages (3) on which the rows of seats (1) are supported, a drive motor (9) being arranged in each carriage (3).

Figure 16:
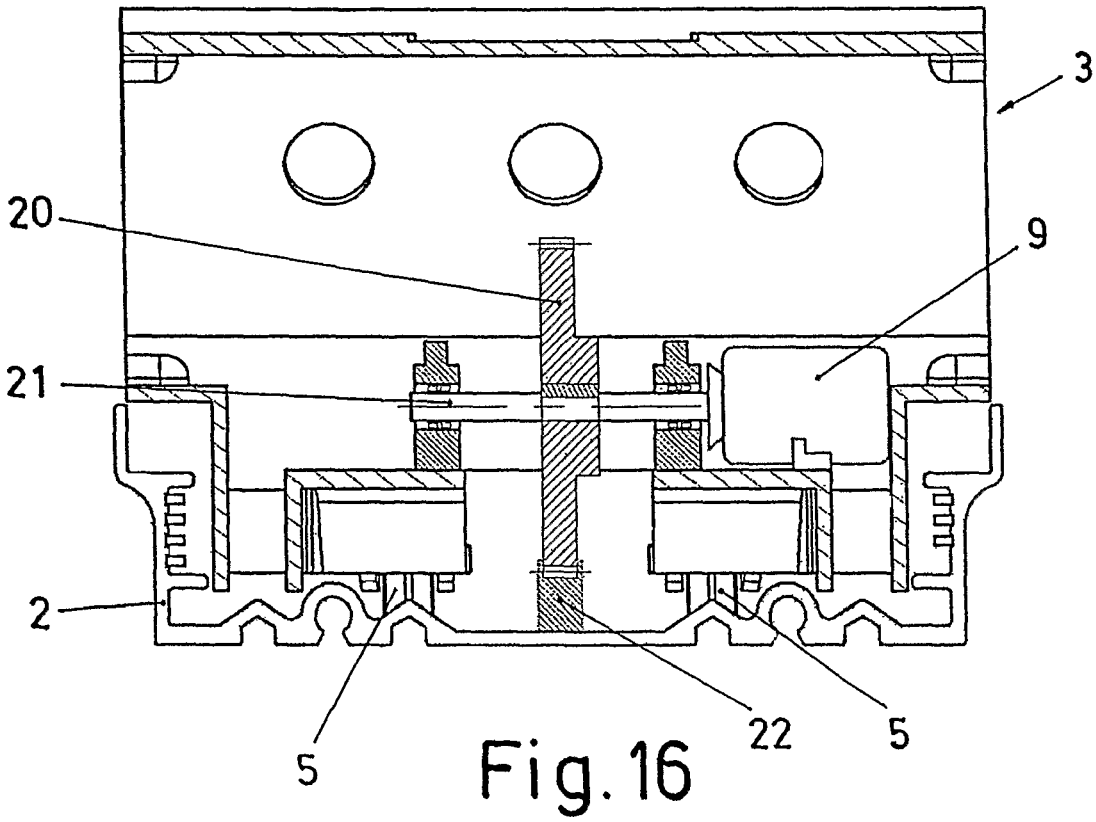
FIG. 16 shows the arrangement of a carriage carrying the rows of mobile seats for the form of movement with motorization in the carriages and actuation on a rack along the guides.

The drive transmission for causing the movements can be, in this case, as shown in FIG. 16, by means of un pinion (20) coupled to the shaft (21) of the motor (9) incorporated in the carriage (3), said pinion (20) establishing a gear on a rack (22) arranged along the mounting guide (2), whereby when the motor (9) starts operating due to the commands of the control system, it causes the rotation of the pinion (20), determining the circulation of the latter through the rack (22) with the subsequent drive of the carriage (3) in the corresponding direction according to the rotation direction of the motor (9).

Figure 17:
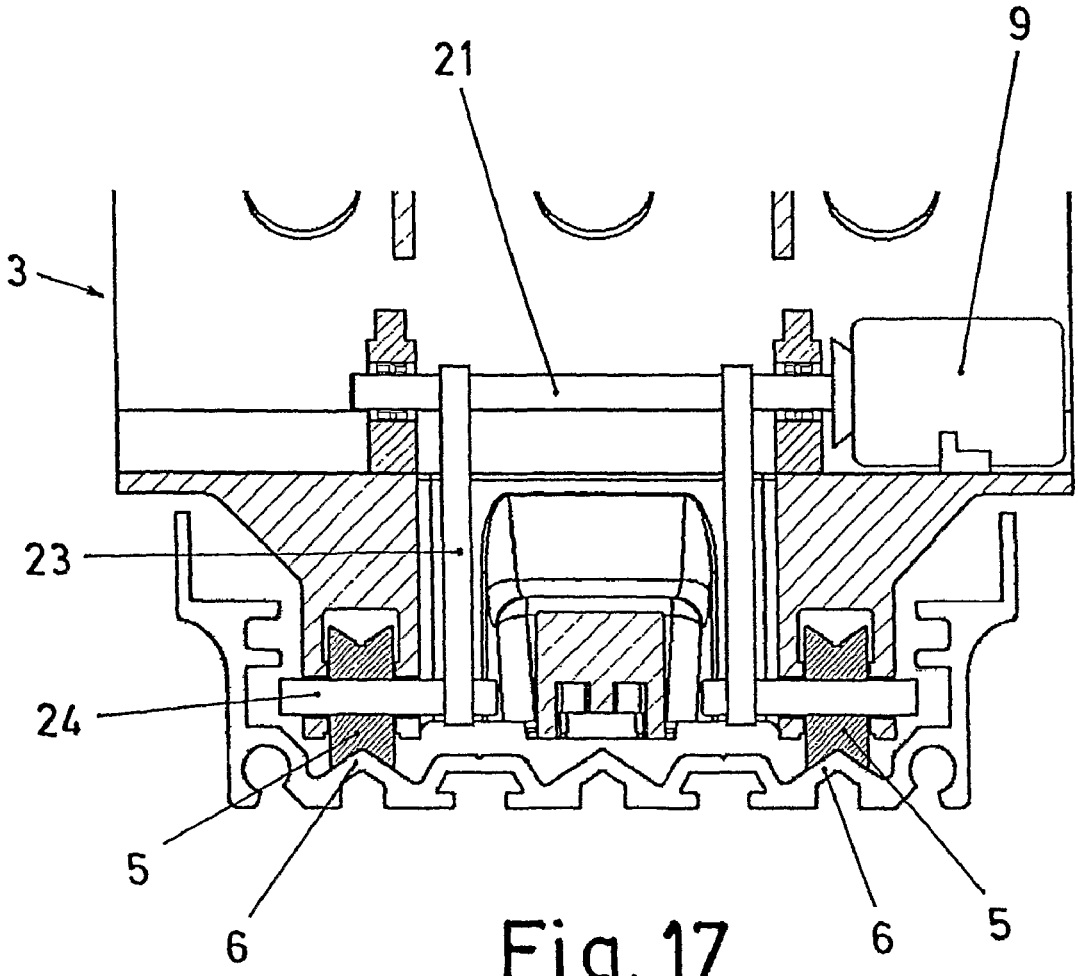
FIG. 17 shows the arrangement of a carriage carrying the rows of mobile seats for the form of movement with motorization in the carriages and transmission to the support wheels on the guides.

The drive transmission can also be, with the same result, as observed in FIG. 17, by means of actuating the wheels (5) of the carriages (3), a transmission (23) being established from the shaft (21) of the motor (9) incorporated in each carriage (3) to the axles (24) of the wheels (5) of the corresponding carriage (3), whereby when the motor (9) rotates, it makes the wheels (5) of the carriage rotate, causing the movement along the corresponding mounting guide (2) with the subsequent travel of the carriage (3).

In these case of transmission of the movement by means of motorization incorporated in the carriages (3), the locking of the rows of seats (1) in the static positions is determined by the actual retention established by the motors (9) when they are stopped, but in order to better assure the immobility of the rows of seats (1), the transmission system can also be complemented in these cases with an electromagnet for locking on the floor in relation to the corresponding mounting guide (2).

The movement system of the rows of seats (1) can be established in any case by means of respective drive transmission by each of the guides (2) on which the assembly of said rows of seats (1) is arranged, according to the embodiments shown in FIGS. 10, 12 and 15, a synchronization control between the transmissions being established in such case by the different mounting guides of the rows of seats (1) by means of the master PLC of the installation, depending on the signals of the position detectors incorporated in the carriages (3) of the different transmissions.

Figure 18:
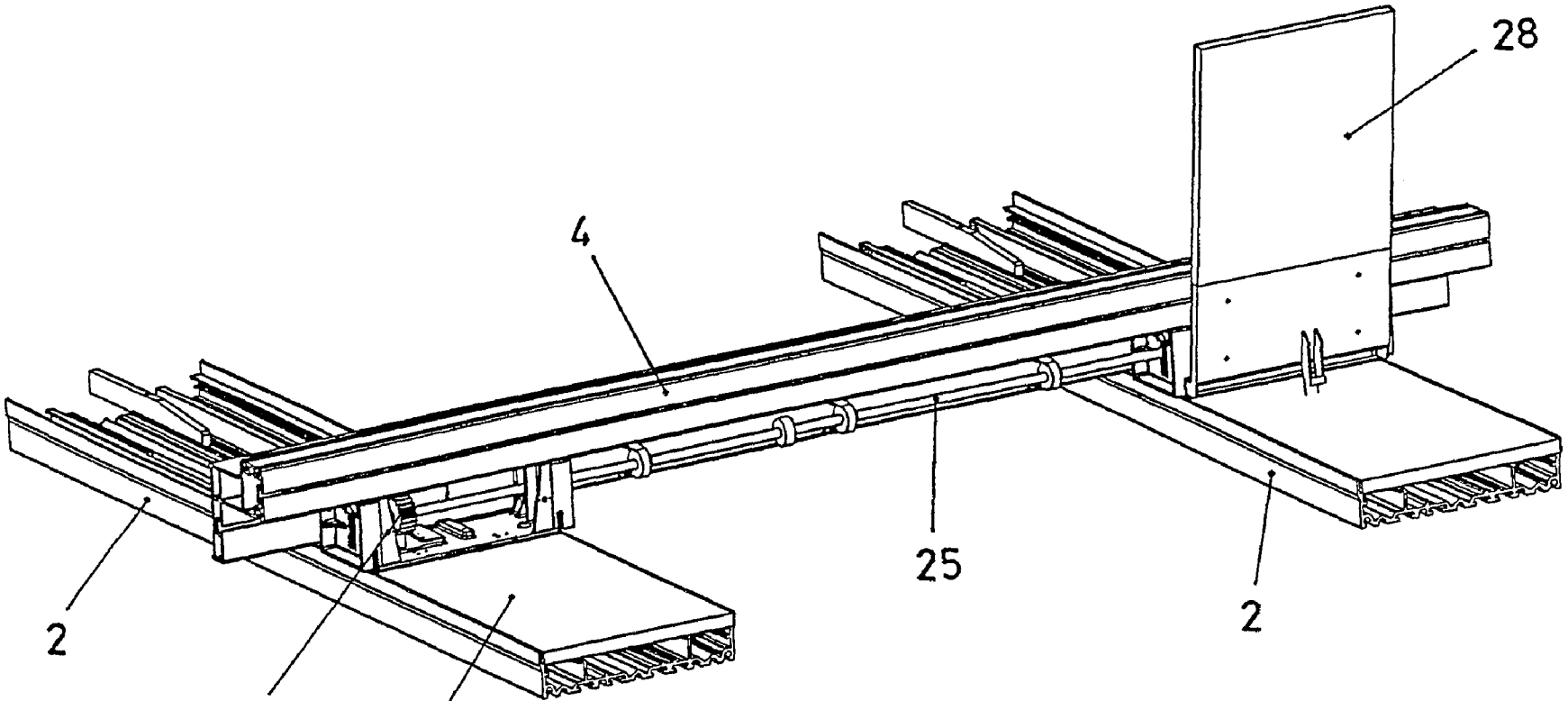
FIG. 18 is a detail of the assembly of a base of a row of seats on two guides, with drive transmission on a single side and mechanical synchronization in connection with the transmission of the other side.

For the purpose of reducing the drive motors (9) and the conductions (11) in the installation, a functional arrangement with drive transmission by only one of the mounting guides (2) of the rows of seats (1) and mechanical synchronization by means of transverse bars (25) with gears (26), in relation to the transmission without drive actuation by the other mounting guides (2) of the rows of seats (1), is also provided, as shown in FIG. 18.

Figure 19:
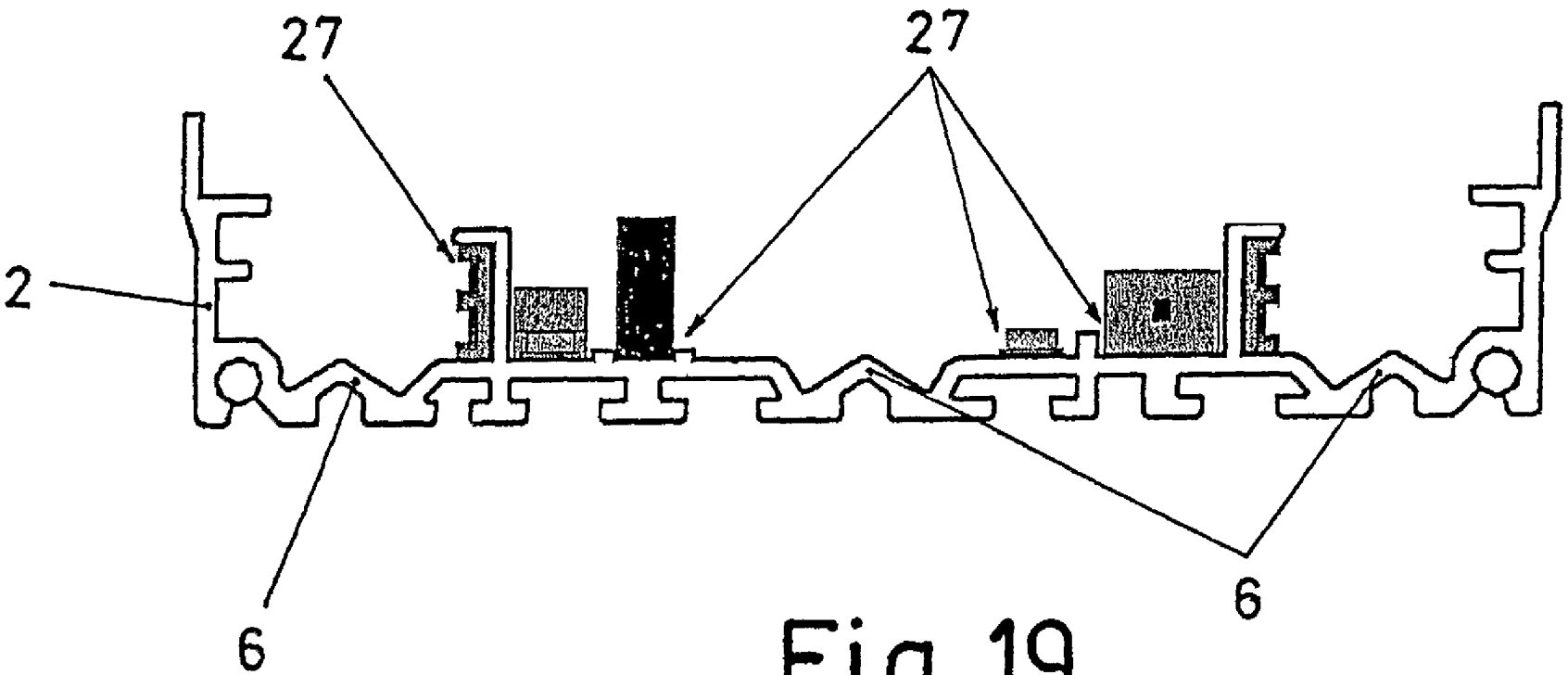
FIG. 19 shows a cross-sectional view of an embodiment of a guide for mounting the rows of mobile seats, with a particular distribution of the elements forming the system.

The guides (2) for the movement assembly of the rows of seats (1) is formed by grooved profiles which can be configured with different shapes, defining the conformations by way of rails (6) for supporting the wheels (5) of the carriages (3) carrying the rows of seats (1), as well as different spaces (27) for the coupling for assembling the elements forming the movement installation of the rows of seats (1), such as for example the embodiment shown in FIG. 19, without this being a limiting form.

Said profiles forming the guides (2) are embedded in the floor of the application site, the spaces corresponding to the gaps of the mentioned guides (2) being covered in order to leave the surface of the application floor uniform, by means of plates by way of lids which are removed to carry out the movements of the rows of seats (2).

In this sense, to cover the gaps of the guides (2) between the rows of seats (1) in the deployed position thereof over the application premises, plates (28) are provided with the measurement corresponding to the separation distance between the rows of seats in a standard distribution thereof, which plates (28) can be manually placed and removed but can also be arranged in an automatic raising and lowering assembly, according to the collected and deployed positions of the rows of seats (1).

Said automatic positioning assembly of the plates (28) can be by actuation means such as hydraulic cylinders, pneumatic cylinders, electromagnets, etc., arranged for said purpose in the carriages (3), an operation solution combined with the movement of the rows of seats (1) between the corresponding deployed and corrected positions in the installation preferably being provided.

To that end, the plates (28) are articulated to the corresponding the carriages (3) of the rows of seats (1), incorporating a stop (29) below, whereas in the area of entrance to the collection sites of the rows of seats (1), a ramp (30) is arranged in the guides (2), on which ramp said lower stop (29) of the plates (28) can be supported in a sliding manner.

Figure 20:
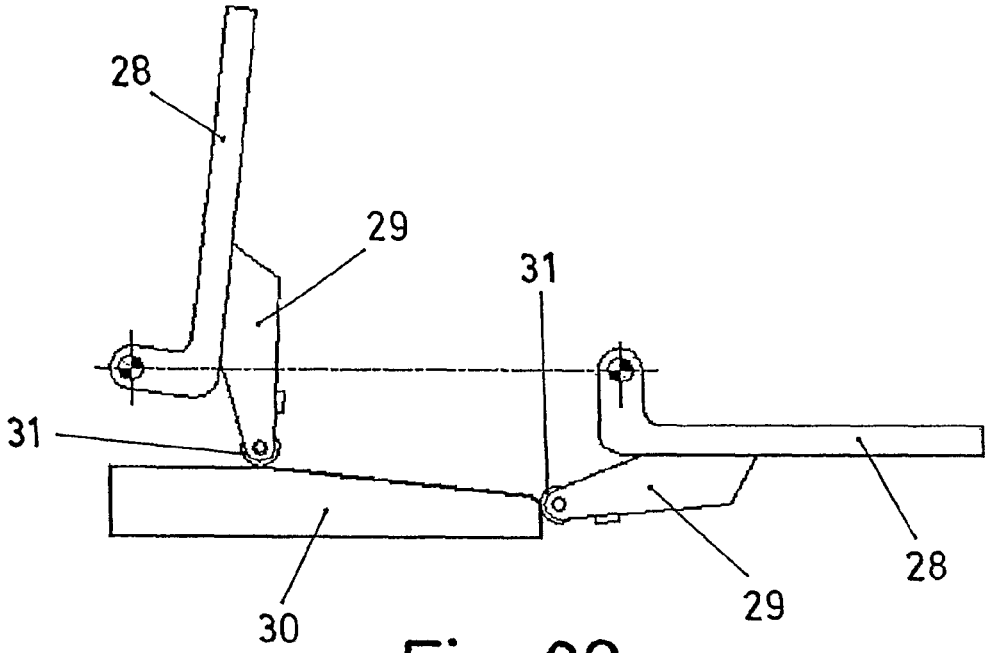
FIG. 20 is a schematic detail of the automatic pivoting arrangement of a covering plate of the guides between the rows of seats, by means of a stop on a ramp.

In such conditions, as shown in FIG. 20, when the rows of seats are moved towards the collection site, in the entrance of said collection site, the plates (28) are supported with their lower stop (29) in the ramp (30) arranged in the corresponding guide (2), which causes a pivoting raising said plates (28), the latter being placed in a vertical position in which they allow moving the rows of seats (1) closer to one another in order to collect them occupying a minimum space.

The end of the stop (29) of the plates (28) is provided with a wheel (31), which facilitates the sliding on the support ramp (30). However, by means of the arrangement of the support of the stop (29) on a simple ramp (30), as in the example of FIG. 20, the plates (28) pivot abruptly if the movement of the rows of seats is quick, and to prevent it, it is necessary to greatly reduce the speed of the movement, which makes the installation very slow.

Figure 21:
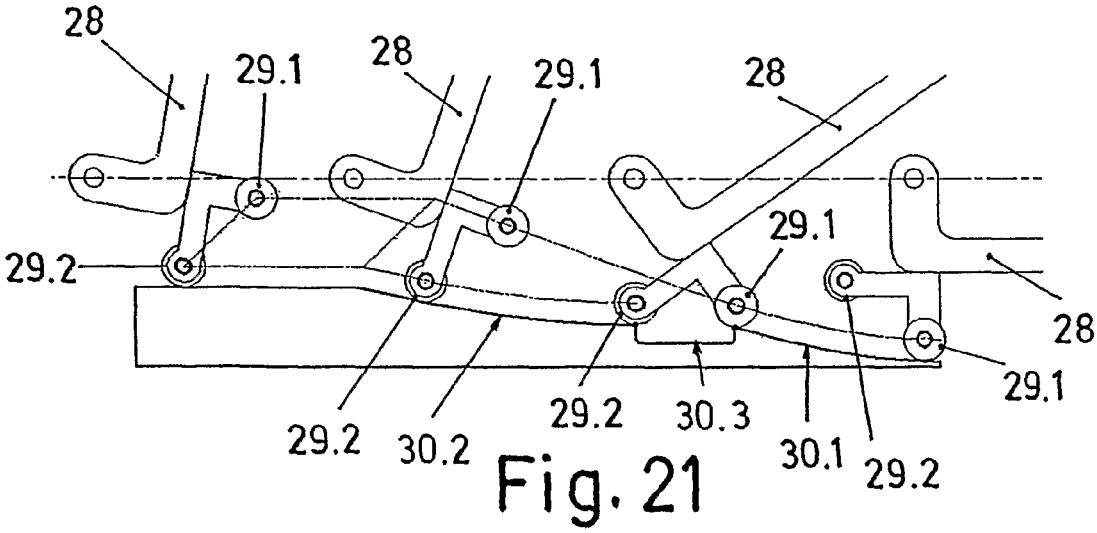
FIG. 21 is a schematic detail similar to the previous one, in an embodiment with two support stops on areas of a ramp with a different configuration.

For the purpose of preventing this phenomenon, the arrangement of a dual stop (29.1, 29.2) in the lower part of the plates (28) is provided, whereas in the guides (2) a ramp defined with two longitudinal areas (30.1 and 30.2) with a different inclination and separated from one another by a free space (30.3) is arranged, as observed in FIG. 21.

The contact of the plates (28) on the pivoting ramp thus occurs with a first support by means of the stop (29.1) on the first area (30.1) of the ramp and at the end of said area, in which the corresponding plate (28) has already pivoted to a certain height, the contact of the second stop (29.2) occurs on the second area (30.2) of the ramp, the pivoting of the plate (28) by this second support continuing up to the vertical position, and a result said pivoting of the plate (28) takes place in two successive steps, with a smoothness which allows establishing a relatively quick movement without the mentioned plates (28) pivoting abruptly.

In the movement of the rows of seats (1) from the collected position to the deployed position, when the plates (28) leave the support on the corresponding ramp (30), they fall by themselves to the horizontal position for covering the respective guide (2).

Figure 22:
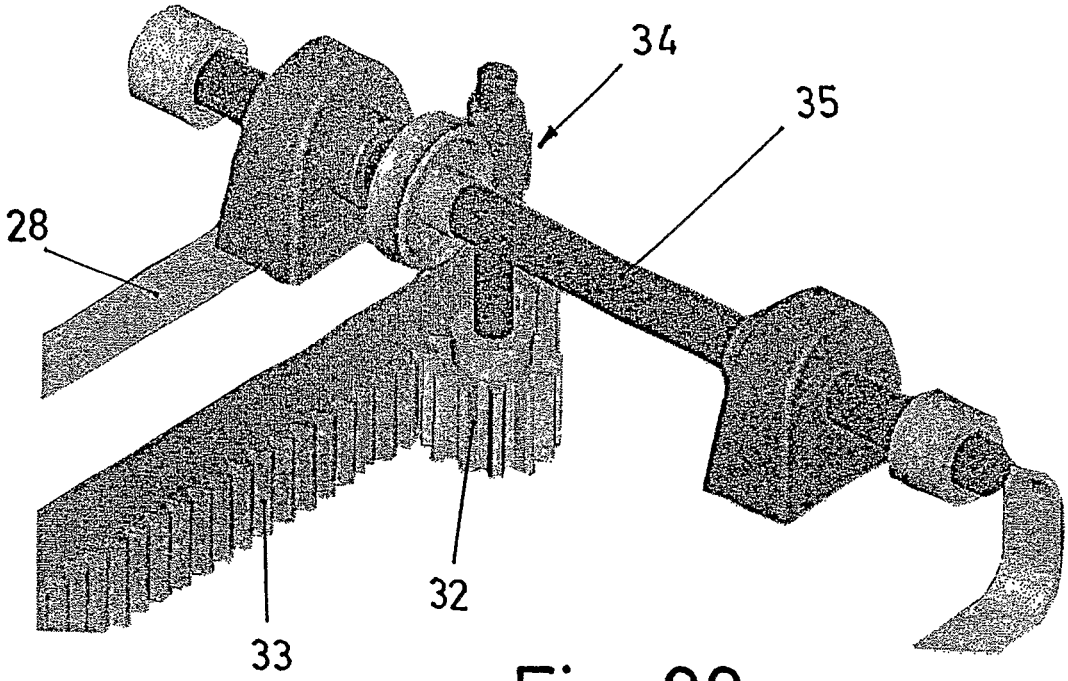
FIG. 22 is a perspective detail of another solution for mechanically pivoting the plates for covering the guides between the rows of seats.

Another solution for pivoting the plates (28) depending on the movement of the rows of seats (1) is for example, as shown in FIG. 22, by means of a gear arrangement by a pinion (32) on a rack (33) and a rotation transmission coupling (34) on a pivoting shaft (35) of the corresponding plate (28), such that upon the rows of seats (1) moving, when the pinion (32) comes into contact with the rack (33), a rotation occurs which by means of the coupling (34) makes the shaft (35) rotate and as a result the corresponding plate (28) pivots in the raising or lowering direction according to the direction of the movement of the rows of seats (1).

According to the proposed system, the mobile installation of the rows of seats (1) is provided for the purpose of enabling the adaptation of the application sites by means of distributing the rows of seats (1) in a position of use thereof or by means of removing the rows of seats (1) to a collected position, clearing up the surface of the application site in order to carry out activities requiring one type of arrangement or another.

Figure 24A:
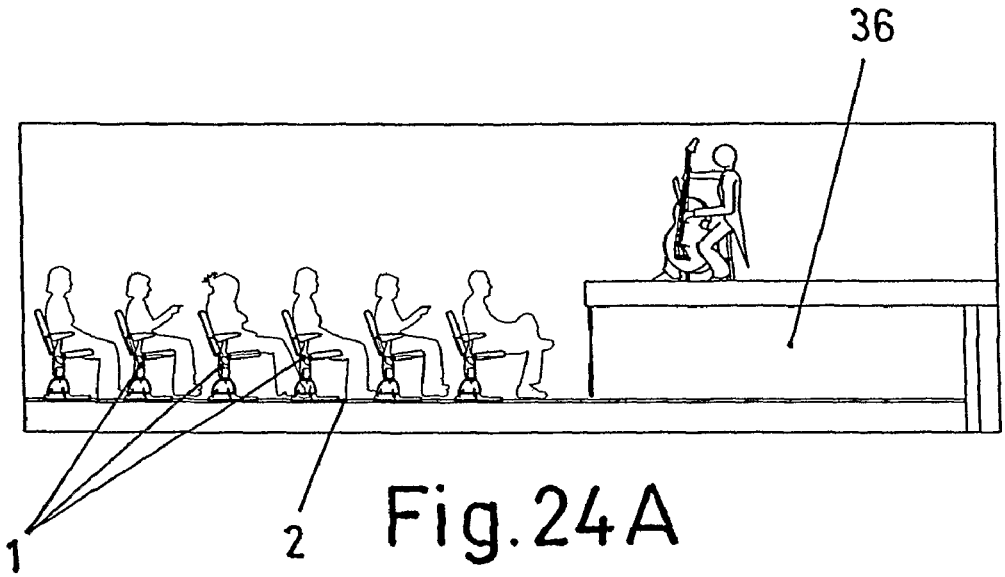
FIGS. 24A, 24B and 24C show a sequence of the collection of an assembly of rows of seats in relation to a storage housing located at the floor level of the installation of the seats.
Figure 24B:
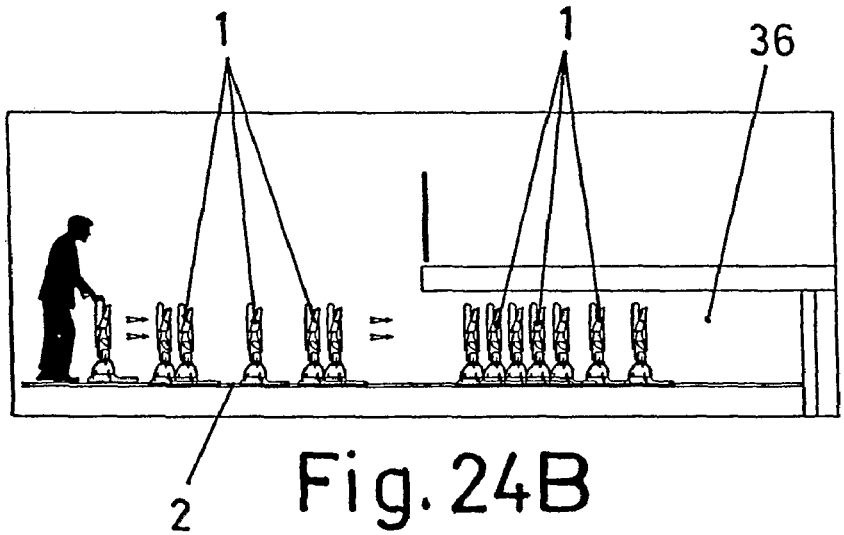
Figure 24C:
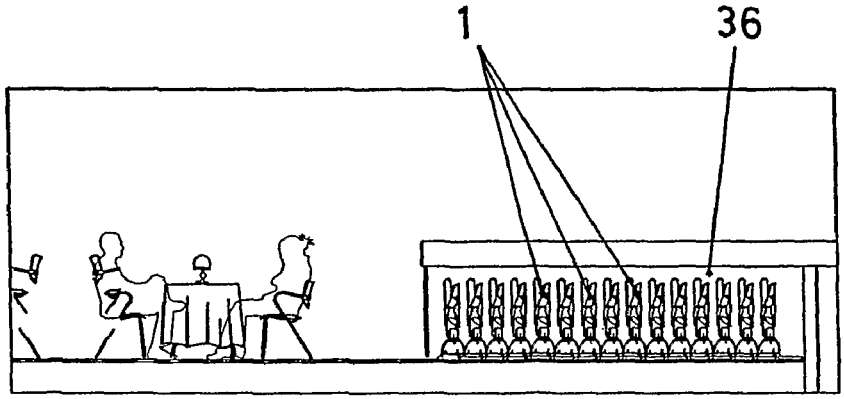

In this sense, the installation of the rows of seats can be established with a movement arrangement in a horizontal floor for collecting up the rows of seats (1) in storage sites (36) located on the same level of the application floor, for example under a fixed stage, like in the example shown in FIGS. 24A to 24C.

Figure 25A:
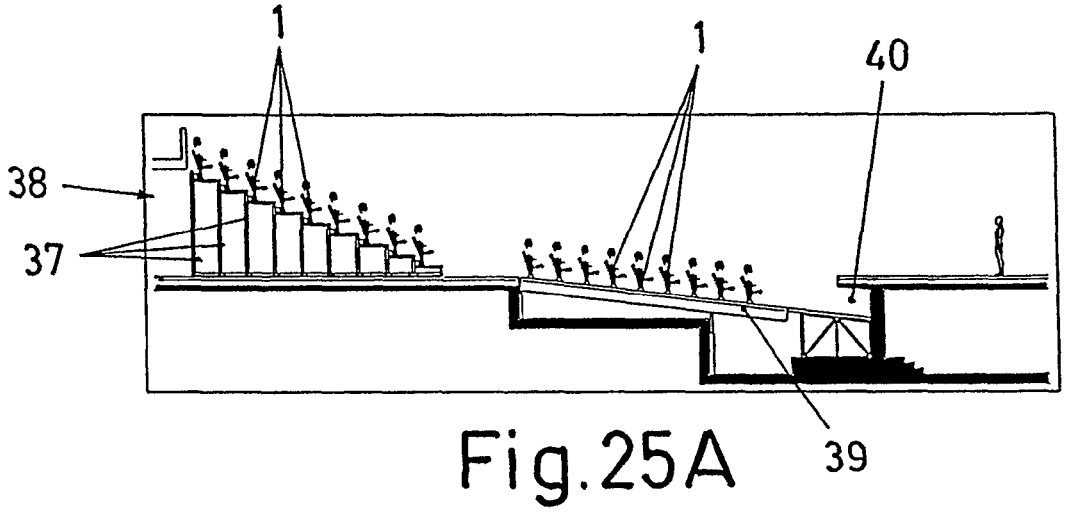
FIGS. 25A, 25B and 25C show a sequence of the collection of the rows of seats of premises in a vertical storage and in a storage housing located under the floor level.
Figure 25B:
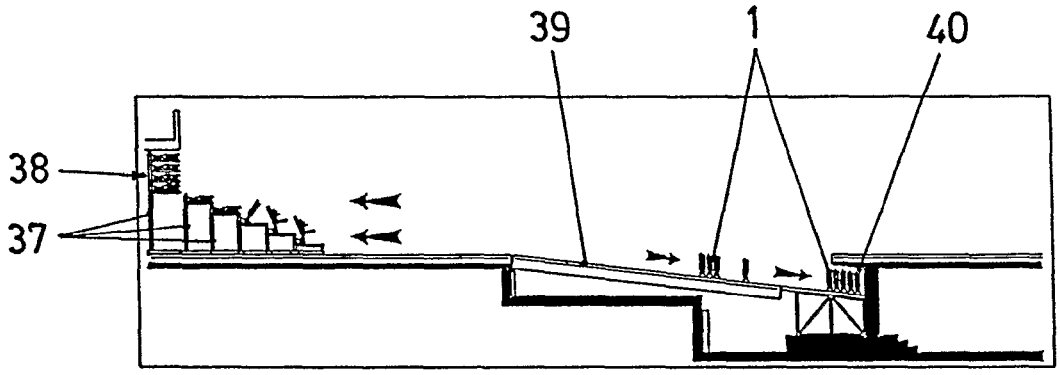
Figure 25C:
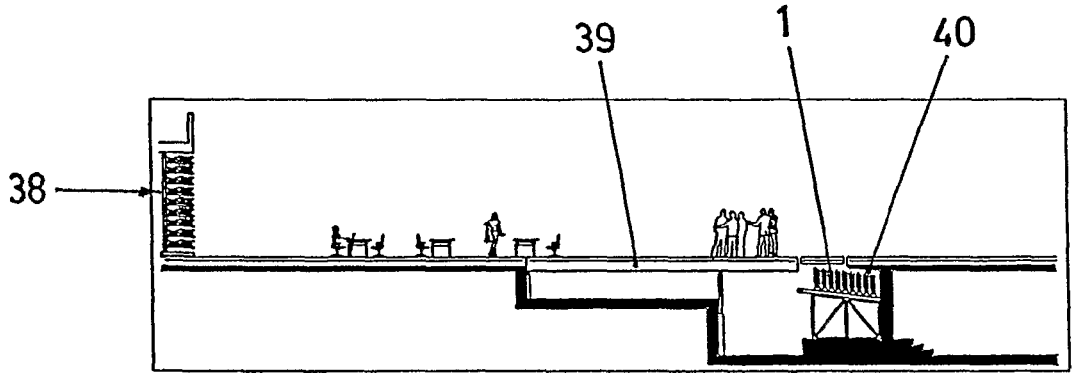
Figure 26:
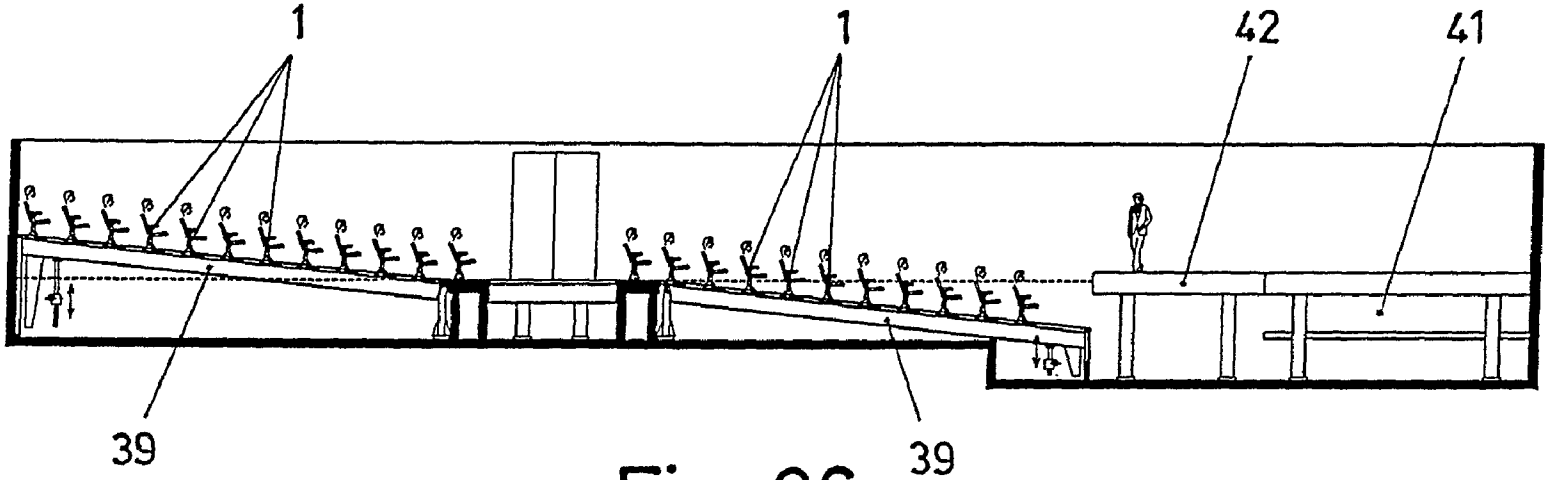
FIGS. 26 and 27 show two examples of arranging rows of seats on parts of a floor, which can be placed in an inclined or horizontal manner.
Figure 27:
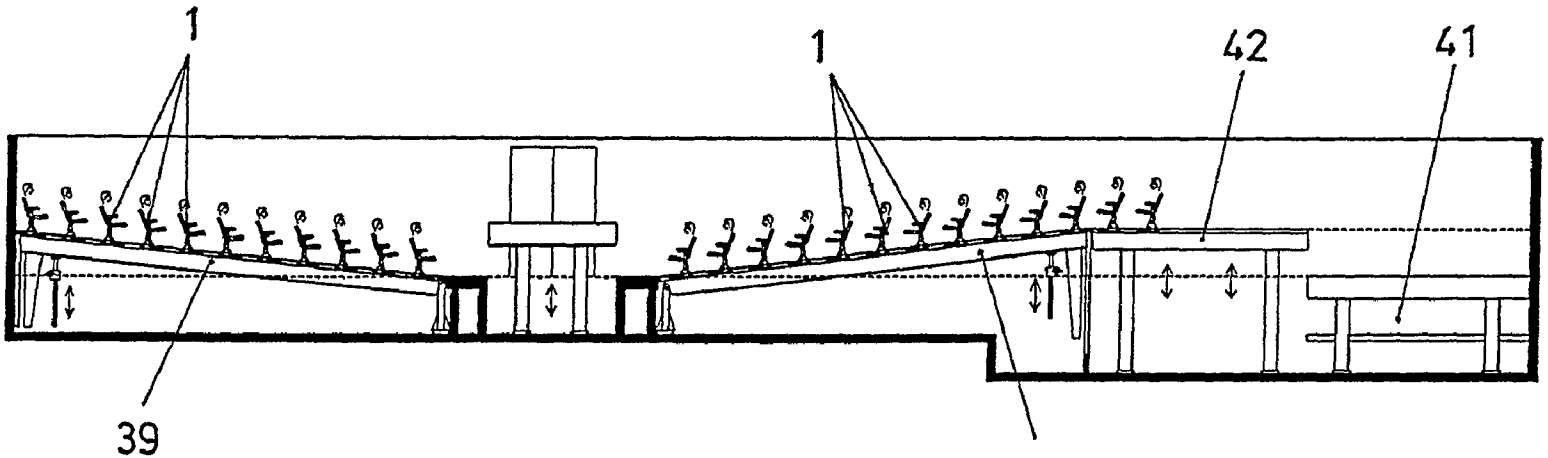
Figure 28A:
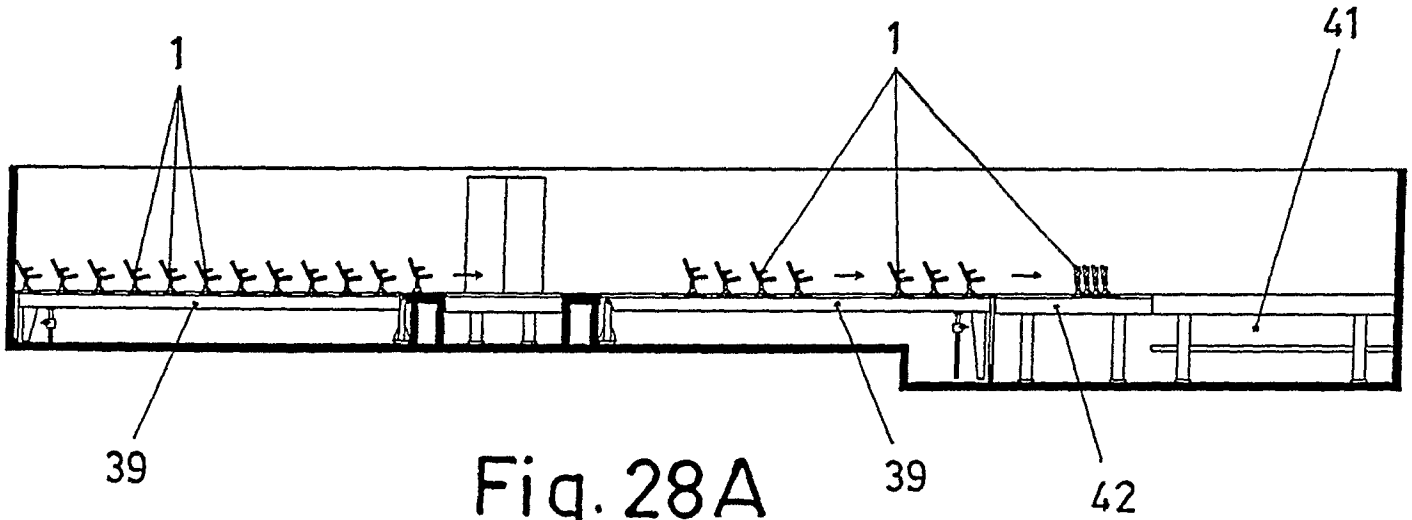
FIGS. 28A and 28B show a sequence of the collection of the rows of seats in a housing located under the floor level, by means of a floor section which can be moved in height.
Figure 28B:
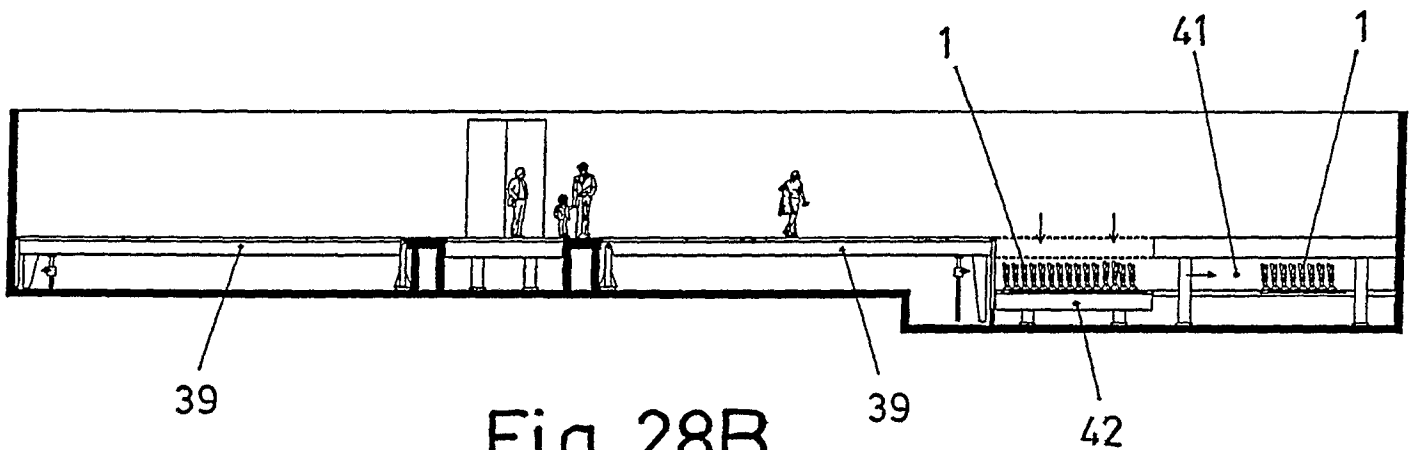

The assembly of the installation can also be in an arrangement of the rows of seats (1) on stepped structures (37) which can be collected in a vertical storage (38), as well as on floor parts (39) which can be pivoted between a horizontal position and an inclined position, with the collection of the corresponding rows of seats (1) in a storage site (40) located under the horizontal floor level, as in example shown in FIGS. 25A to 25C.

Likewise, the rows of seats (1) can be collected in fixed sites (41) located under the floor level, with access for introducing and removing the rows of seats (1) in relation thereto by means of a floor part (42) which can be moved vertically like an elevator, as in the example of FIGS. 26 to 28B.

Figure 29A:
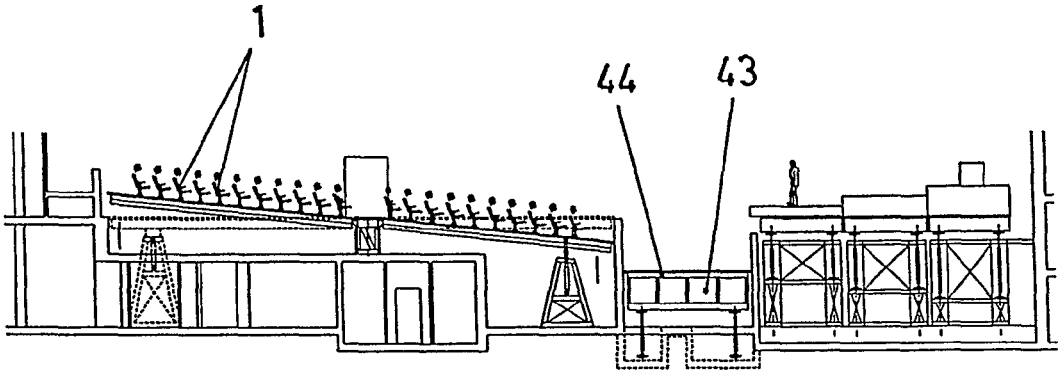
FIGS. 29A, 29B and 29C show a sequence of the collection of the rows of seats in a housing located under a part of the corresponding premises which can be moved in height.
Figure 29B:
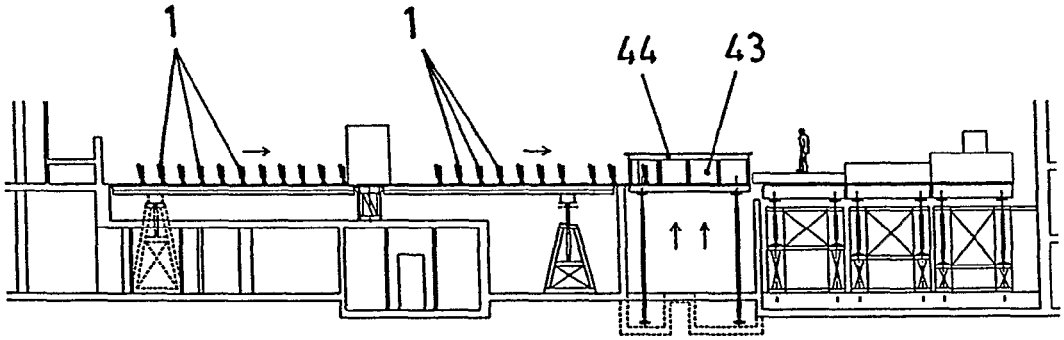
Figure 29C:
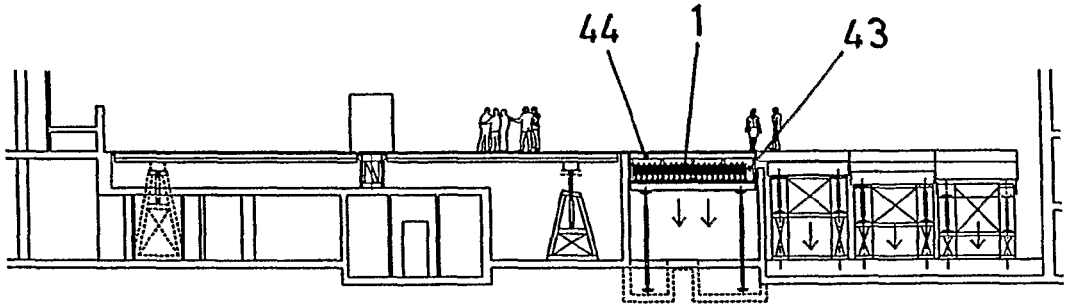

Another possibility in the same sense is the collection of the rows of seats (1) in storage sites (43) located under floor parts (44) capable of raising and lowering movement, as in the example of FIGS. 29A to 29C, such that by means of raising the floor part (44) involving the storage site (43), the rows of seats (1) can be introduced in said storage site (43) in order to later, by means of lowering the part (44) to its normal level, leave the rows of seats (1) stored under the floor level, the surface of the floor being cleared up.

Figure 30:
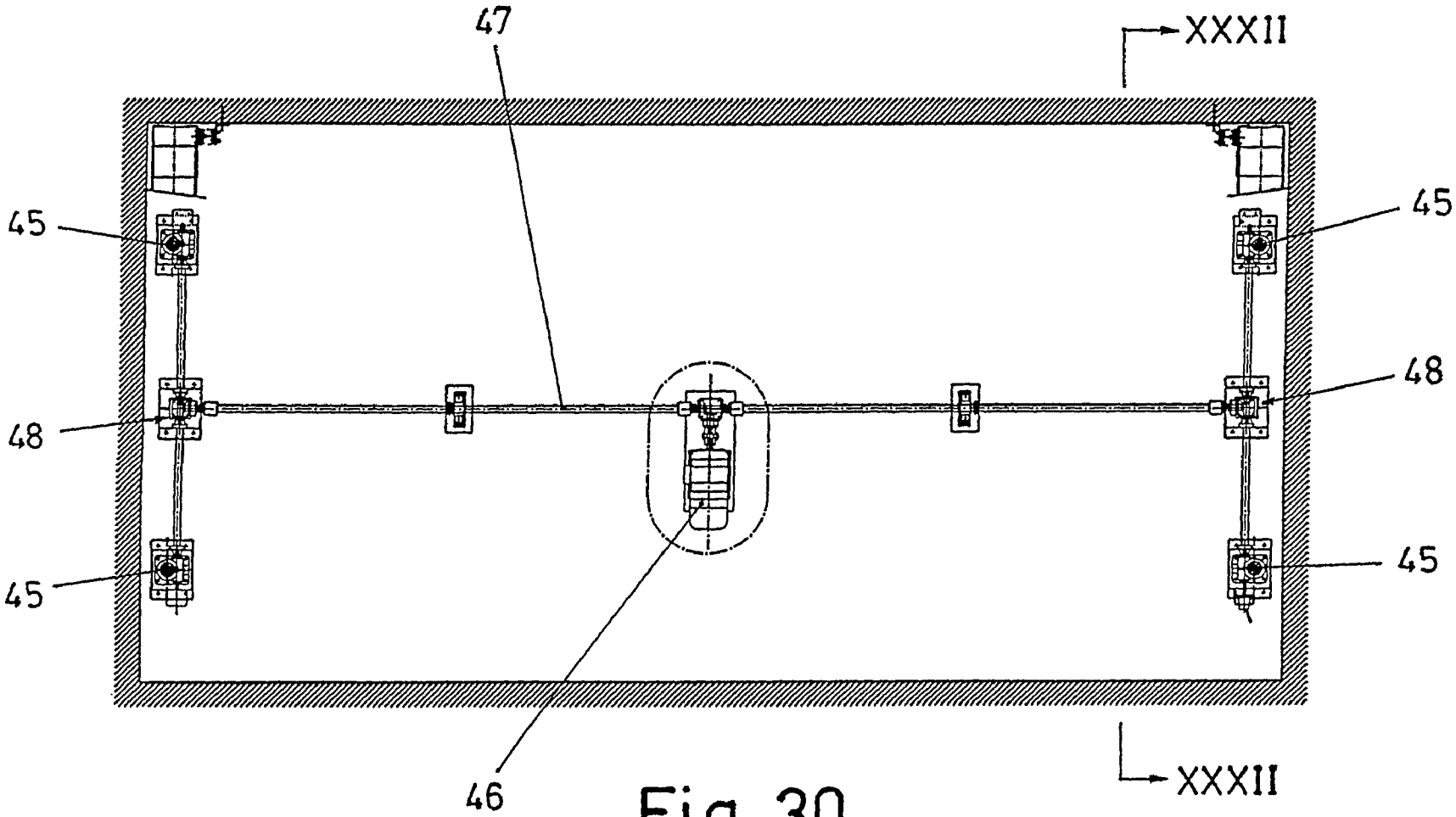
FIG. 30 is a plan view of the arrangement of the actuation of the parts capable of vertical movement by means of four spindles driven by a motor.
Figure 31:
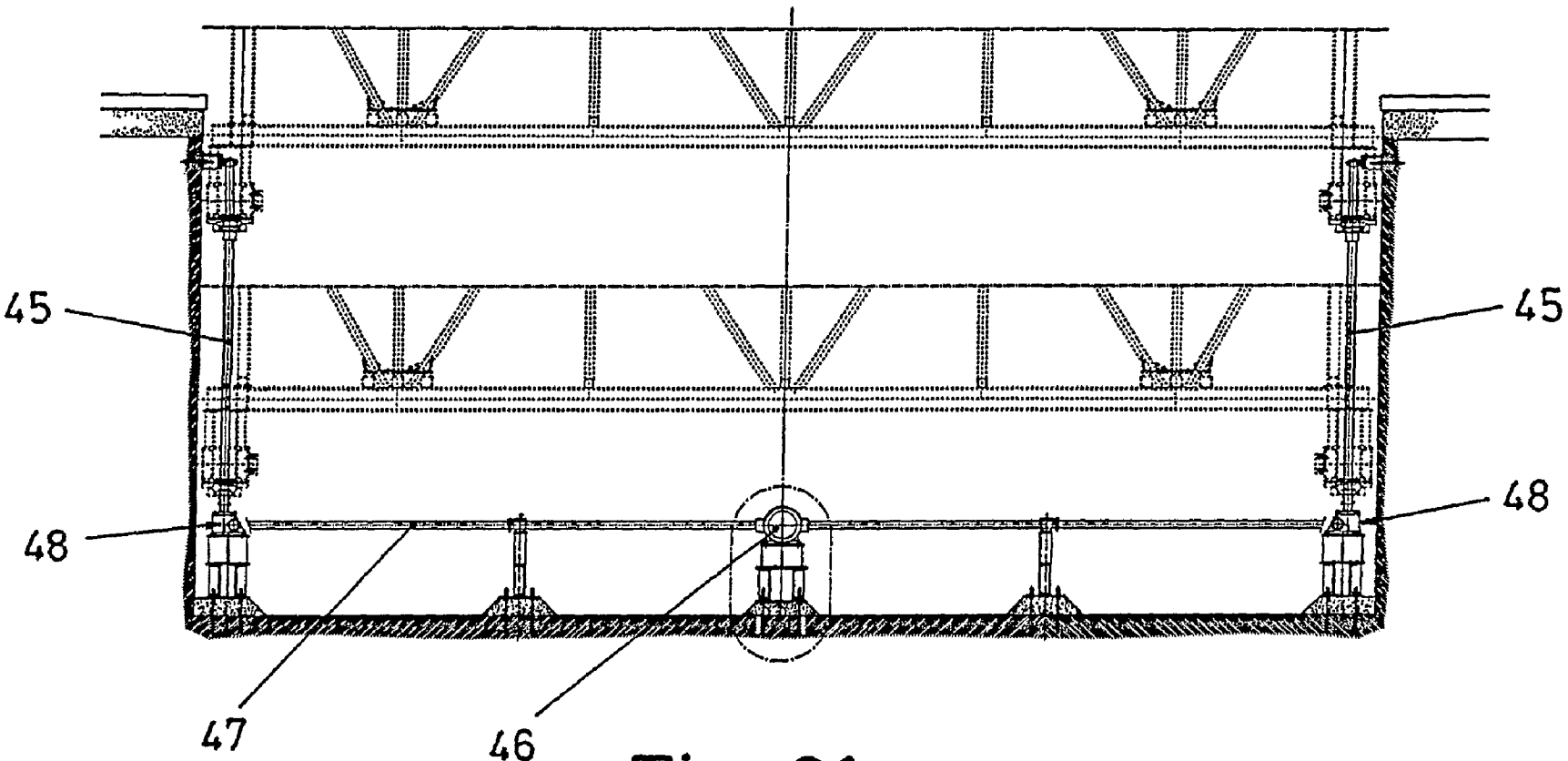
FIG. 31 is a side elevational view of the arrangement of the previous figure.
Figure 32:
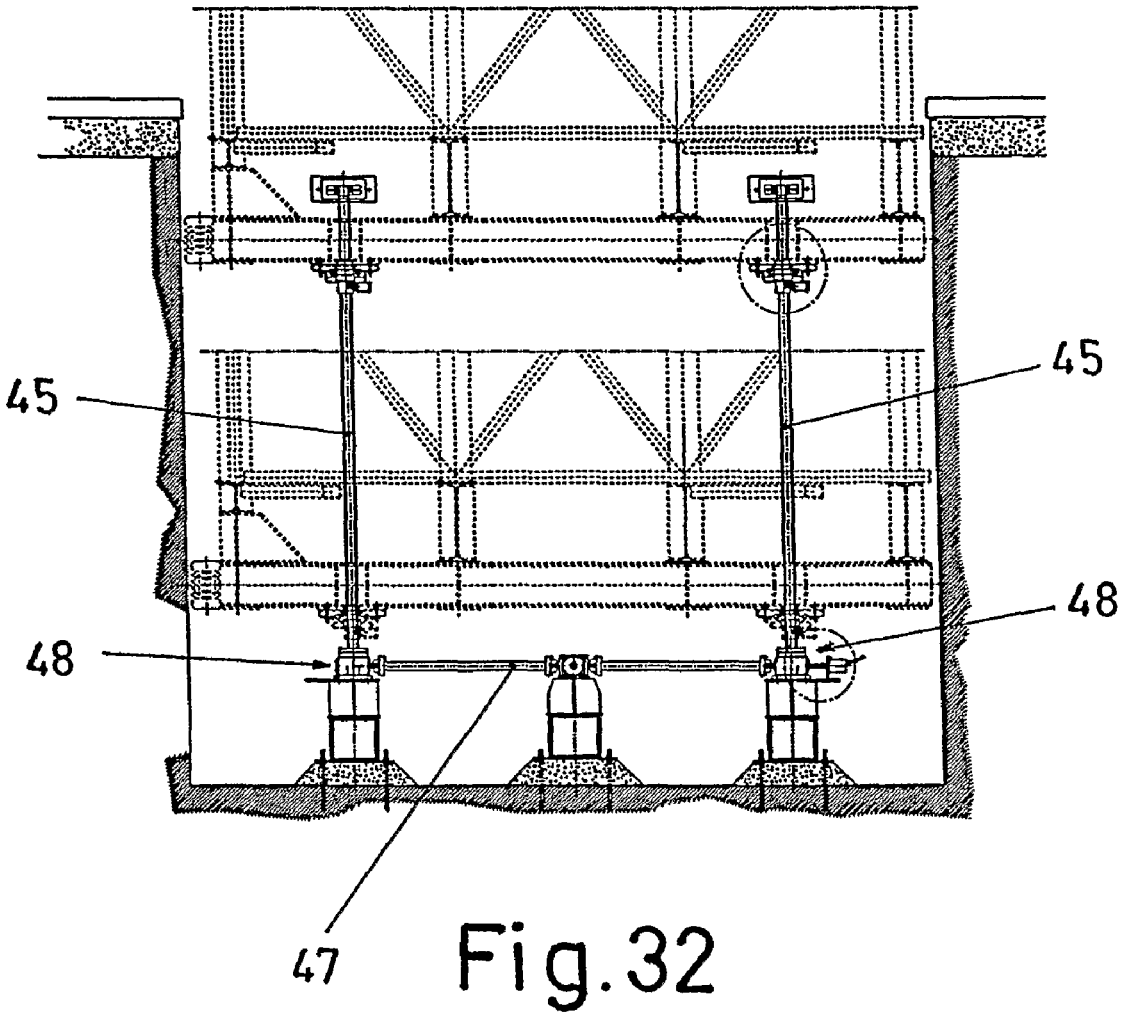
FIG. 32 is a view according to section XXXII-XXXII indicated in FIG. 30.

The arrangement of the parts (42, 44) capable of movement in height which can correspond to floor parts or, for example, to a stage which can be placed in a raised position and can be lowered to the floor level, is particularly established (FIGS. 30 to 32) by means of an assembly on four spindles (45) which are driven by means of a single motor (46) with transmission by means of bars (47) and rotation couplings (48) from said motor (46) to each of the spindles (45), a movement in height of the mentioned parts with a perfect horizontal leveling being achieved with this arrangement.

The height movements are further provided with a control of the operation establishing a deceleration in the final section of the runs in order to achieve that, when the mobile part is stopped, the sections of guides (2) which are incorporated therein are suitably opposite to the corresponding sections of guides (2) located in the fixed adjacent parts. By determining a movement deceleration section in these cases according to the speed of the movement of the mobile parts, an accuracy of the order of +/−1 millimeter can be achieved in the opposition of the sections of the guides (2), whereby the movement of the rows of seats (1) does not undergo considerable alterations upon passing through the interrupted areas.

Figure 33:
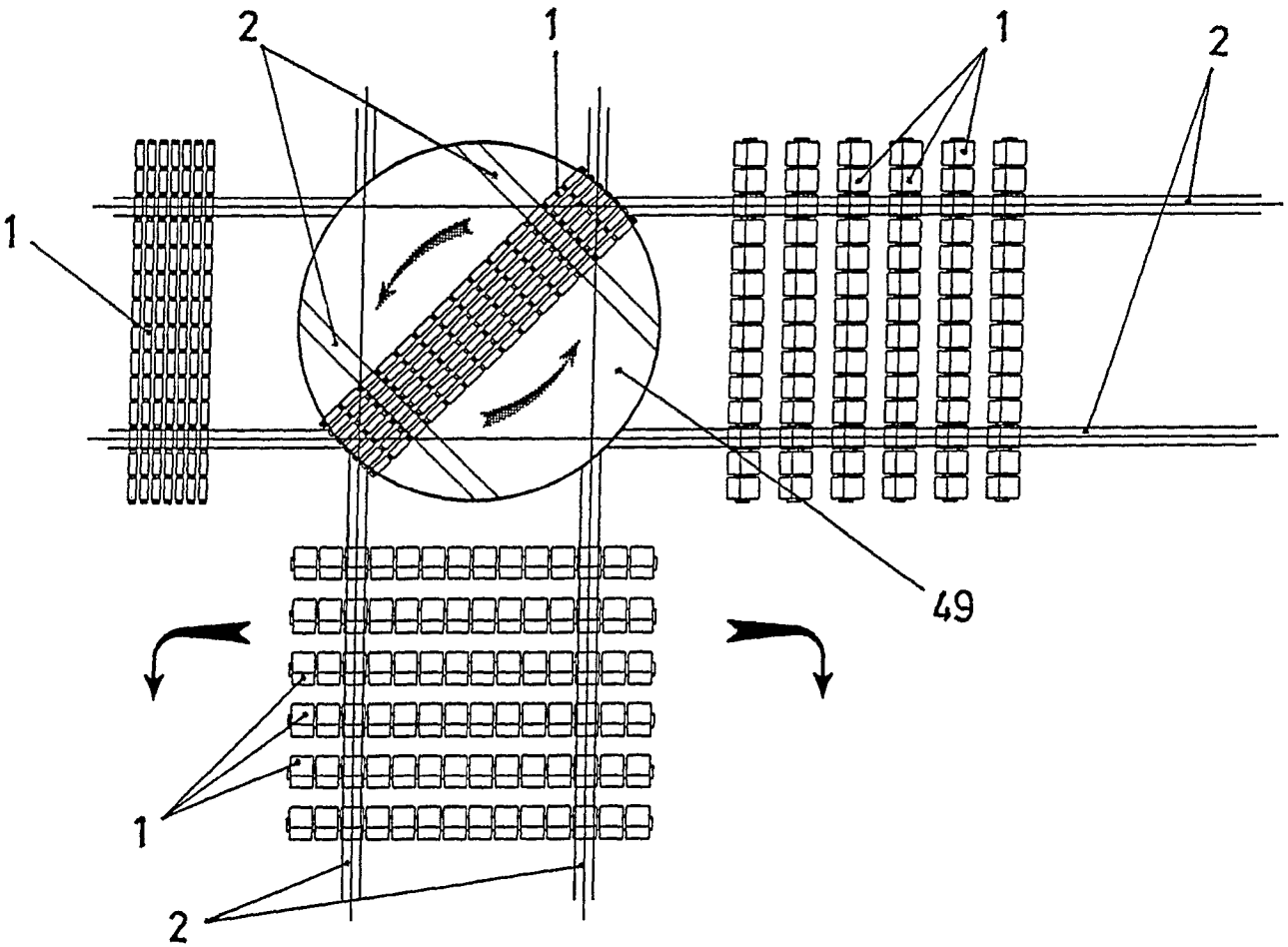
FIG. 33 shows an example of the arrangement of rows of mobile seats on a floor provided with a rotating area to change the direction of the movement of the rows of seats.

The application floor of the installation of the rows of mobile seats (1) can also have rotating areas (49), by means of which the direction of the movement of the rows of seats (1)

can be changed in relation to guides (2) arranged in other directions, as shown in FIG. 33.

The described solutions are embodiments to which the installation of the rows of mobile seats (1) according to the object of the invention is not limited because said installation can be formed in any constructive shape which meets the indicated particularities and features of the movement of the rows of seats (1) in any distribution.

In this sense, the data transmission to the carriages (3) carrying the rows of seats (1) can also be carried out from a control computer by means of a wireless data transmission card, whereby physical elements in the transmission are eliminated, improving the cost, and other functionalities are furthermore enabled, such as automatic communication of errors in the mobile elements, failure diagnosis and the contribution of correction solutions by means of Internet connection.

The actuation of the floor parts (42, 44) which are mobile in height can also be carried out, with the same effect for the operation of the system, with other solutions other than that of the spindles (45) commonly driven by a motor (46), such as for example by means of pneumatic or hydraulic cylinders, pinion and rack mechanisms, etc., the use of which does not alter the concept of the system of the invention.

The invention claimed is:

1. A seat-assembly movement system, comprising: rows of seats arranged in a sliding assembly by means of carrier carriages on guides housed in the floor of the application site, with the possibility of movement between a collected position in storage sites and a deployed position in distribution over the application site, with actuation by drive means incorporated in the actual carriages carrying the rows of seats or at the ends of the installation, the movement of the rows of seats being managed by means of a control system formed by a master PLC governing the entire installation, in combination with respective slave PLCs which are arranged in each carriage carrying the rows of seats and in connection with devices for controlling the position of the carriages on the guides; the data transmission and electric transmissions to the carriages being established by busbars incorporated along the actual movement mounting guides, characterized in that plates for covering the guides are articulated in relation to the carriages carrying the rows of seats, said plates being provided at the lower part with a stop intended to establish a sliding contact on a ramp arranged in the area of entrance of the collection sites of the rows of seats, an automatic pivoting of the mentioned plates being established between respective vertical raised and horizontal lowered positions, due to the actual movement of the rows of seats in the collection and deployment movements.

2. A seat-assembly movement system according to claim 1, wherein the lower stop of the plates is provided with a dual stop to be supported in two successive phases on a ramp formed with two areas with a different inclination separated by a free space, allowing the non-abrupt pivoting of the plates, regardless of the speed of the movement.

3. A seat-assembly movement system according to claim 1, wherein the rows of seats can be collected in storage sites under the floor level, with access for introducing and removing the rows of seats by means of floor parts which can be moved in height, which are assembled on an assembly of spindles driven by a single motor with rotating drive transmissions to the different spindles.

4. A seat-assembly movement system according to claim 3, wherein the movement of the floor parts which can be moved in height is established with a deceleration control in a final section of the runs in order to determine the stops with accuracy of opposition between the sections of guides located in the fixed parts and in the mobile parts.

* * * * *